US011041132B2

(12) United States Patent
Oki et al.

(10) Patent No.: US 11,041,132 B2
(45) Date of Patent: Jun. 22, 2021

(54) LUBRICATING OIL COMPOSITION, INTERNAL COMBUSTION ENGINE, AND METHOD FOR LUBRICATING INTERNAL COMBUSTION ENGINE

(71) Applicant: IDEMITSU KOSAN CO., LTD., Chiyoda-ku (JP)

(72) Inventors: Hiroshi Oki, Chiba (JP); Motoharu Ishikawa, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 217 days.

(21) Appl. No.: 16/087,393

(22) PCT Filed: Mar. 23, 2017

(86) PCT No.: PCT/JP2017/011763
§ 371 (c)(1),
(2) Date: Sep. 21, 2018

(87) PCT Pub. No.: WO2017/164319
PCT Pub. Date: Sep. 28, 2017

(65) Prior Publication Data

US 2020/0325411 A1 Oct. 15, 2020

(30) Foreign Application Priority Data

Mar. 25, 2016 (JP) ..... JP2016-062670

(51) Int. Cl.
*C10M 137/10* (2006.01)
*C10M 101/02* (2006.01)
(Continued)

(52) U.S. Cl.
CPC ..... *C10M 101/025* (2013.01); *C10M 137/10* (2013.01); *C10M 161/00* (2013.01);
(Continued)

(58) Field of Classification Search
CPC ..... C10M 2205/163; C10N 2020/02; C10N 2030/02; C10N 2030/74; C10N 2040/25;
(Continued)

(56) References Cited

U.S. PATENT DOCUMENTS

2008/0110799 A1* 5/2008 Matsui ..... C10M 169/04 208/19
2010/0130395 A1 5/2010 Tagawa et al.
(Continued)

FOREIGN PATENT DOCUMENTS

CN 101652460 A 2/2010
CN 104508098 A 4/2015
(Continued)

OTHER PUBLICATIONS

Office Action dated Aug. 27, 2019 in Japanese Patent Application No. 2016-062670 (with unedited computer generated English translation).
(Continued)

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

Provided is a lubricating oil composition containing a base oil (A) containing a mineral oil (A1) having a complex viscosity η* at −35° C. of 150 Pa·s or less as measured with a rotary rheometer under conditions at an angular velocity of 6.3 rad/s and a strain amount of 0.1%; a viscosity index improver (B) containing a comb-shaped polymer (B1); and a molybdenum-based friction modifier (C), wherein the content of the molybdenum-based friction modifier (C) in terms of a molybdenum atom is more than 500 ppm by mass and less than 900 ppm by mass on the basis of the whole
(Continued)

amount of the lubricating oil composition, and a NOACK value is 10% by mass or less.

14 Claims, 1 Drawing Sheet

(51) Int. Cl.

| | |
|---|---|
| ***C10M 161/00*** | (2006.01) |
| ***C10M 169/04*** | (2006.01) |
| *C10N 20/00* | (2006.01) |
| *C10N 30/00* | (2006.01) |
| *C10N 10/12* | (2006.01) |
| *C10N 20/02* | (2006.01) |
| *C10N 30/02* | (2006.01) |
| *C10N 40/25* | (2006.01) |

(52) U.S. Cl.
CPC .. *C10M 169/044* (2013.01); *C10M 2205/163* (2013.01); *C10M 2223/04* (2013.01); *C10N 2010/12* (2013.01); *C10N 2020/02* (2013.01); *C10N 2020/071* (2020.05); *C10N 2030/02* (2013.01); *C10N 2030/54* (2020.05); *C10N 2030/74* (2020.05); *C10N 2040/25* (2013.01)

(58) Field of Classification Search
CPC ..... C10N 2020/071; C10N 2030/54; C10N 2010/12
USPC ..... 508/379
See application file for complete search history.

(56) References Cited

U.S. PATENT DOCUMENTS

2015/0133352 A1* 5/2015 Esche ..... C10M 107/00 508/294
2015/0197705 A1 7/2015 Matsui et al.

FOREIGN PATENT DOCUMENTS

| | | | |
|---|---|---|---|
| JP | 2003-501491 | A | 1/2003 |
| JP | 2003-513150 | A | 4/2003 |
| JP | 2011-195734 | A | 10/2011 |
| JP | 2012-201806 | A | 10/2012 |
| JP | 2012-211338 | A | 11/2012 |
| JP | 2014-196435 | A | 10/2014 |
| JP | 2015-25079 | A | 2/2015 |
| WO | WO 2008/123246 | A1 | 10/2008 |
| WO | WO 2009/119332 | A1 | 10/2009 |
| WO | WO 2014/017557 | A1 | 1/2014 |
| WO | WO 2014/021350 | A1 | 2/2014 |
| WO | WO 2014/125683 | A1 | 8/2014 |
| WO | WO 2016/043333 | A1 | 3/2016 |
| WO | WO 2016/043334 | A1 | 3/2016 |

OTHER PUBLICATIONS

International Search Report dated May 23, 2017, in PCT/JP2017/011763 filed Mar. 23, 2017.
Japanese Office Action dated Mar. 31, 2020 in Japanese Patent Application No. 2016-062670 (with unedited computer generated English translation), 8 pages.
Japanese Office Action dated Sep. 29, 2020 in Japanese Patent Application No. 2016-62670 (with unedited computer generated English translation), 13 pages.
Office Action dated Mar. 3, 2021 in Chinese Application No. 201780019108.7 (w/ English translation).
Hu Hongwen, "Organic Chemistry", Higher Education Press, p. 29, May 31, 1990 (w/ English translation of pertinent part).

* cited by examiner

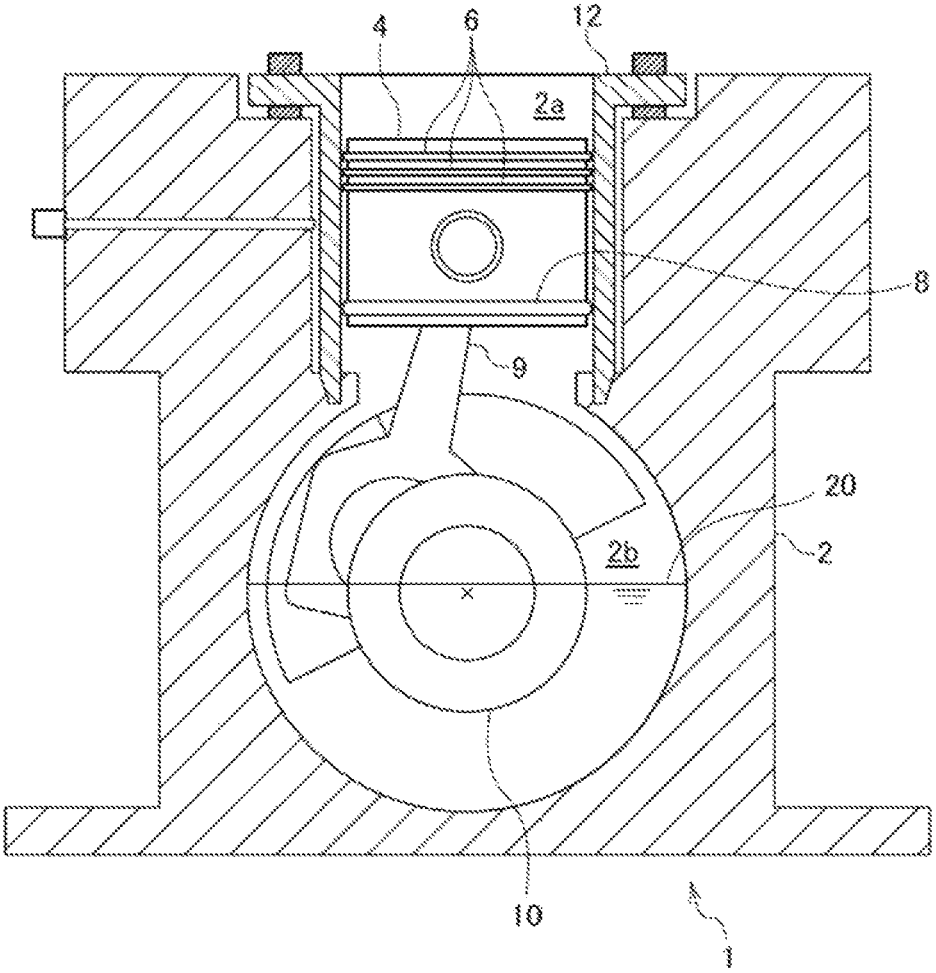
4
6
12
2a
8
9
20
2
2b
10
1

LUBRICATING OIL COMPOSITION, INTERNAL COMBUSTION ENGINE, AND METHOD FOR LUBRICATING INTERNAL COMBUSTION ENGINE

TECHNICAL FIELD

The present invention relates to a lubricating oil composition, an internal combustion engine using the lubricating oil composition, and a method for lubricating an internal combustion engine with the lubricating oil composition.

BACKGROUND ART

In recent years, from the viewpoints of reducing an energy loss and reducing the generation amount of carbon dioxide, improvement of fuel consumption is required for vehicles, such as automobiles, and an improvement of thermal efficiency of engines using a supercharger has been studied.

In addition, an improvement of fuel consumption performance is also required for engine oils to be used for vehicles, such as automobiles.

As one means for saving fuel consumption of an engine oil, the development of an engine oil with an excellent friction-reducing effect is performed. For example, in order to produce an engine oil with an excellent friction-reducing effect, an organic molybdenum-based compound is frequently used as a friction modifier.

For example, PTL 1 discloses a lubricating oil composition having a predetermined kinematic viscosity and containing a lubricant oil base oil having a % $C_P$ of 70 or more and a % $C_A$ of 2 or less, a viscosity index improver that is a copolymer of a macromolecular monomer composed of at least a polyolefin and a (meth)acrylate monomer and an organic molybdenum compound in an amount of 1,000 ppm by mass or more in terms of molybdenum.

CITATION LIST

Patent Literature

PTL 1: JP 2012-201806 A

SUMMARY OF INVENTION

Technical Problem

In the lubricating oil composition described in PTL 1, plenty of the molybdenum-based friction modifier is blended in the content of 1,000 ppm by mass or more in terms of a molybdenum atom. In general, the molybdenum-based friction modifier is hardly soluble in a base oil and readily precipitates as a precipitate particularly against a high-purity base oil after being allowing to stand. In such a case, there is a concern that the friction-reducing effect due to the addition of a molybdenum-based friction modifier is not thoroughly revealed.

Accordingly, in an engine oil containing a molybdenum-based friction modifier, there is a requirement for an improvement in solubility of the molybdenum-based friction modifier in the base oil.

In addition, when a supercharger is mounted on an engine of an automobile or the like, the thermal efficiency of an engine is improved, whereas a thermal load to the lubricating oil composition to be used for the engine increases.

For example, in the case of using a high-evaporativity lubricating oil composition for an engine mounted with a supercharger, the evaporation of the lubricating oil composition becomes large due to an increase of thermal load, and the matter that the amount of oil necessary for lubrication of an engine part cannot be thoroughly kept is occasionally generated. As a result, this may cause breakage of the engine part. Accordingly, low evaporativity is also required for the lubricating oil composition to be used for an engine.

In the lubricating oil composition whose specific composition is disclosed in the working examples of PTL1, a base oil having a NOACK value of at least 12% by mass is used, and therefore, in the case where the foregoing lubricating oil composition is used for an engine mounted with a supercharger, the concern about generation of the aforementioned harmful effects is large.

On the other hand, by using a high-viscosity mineral oil-based base oil, though the evaporation of the lubricating oil composition is suppressed, there is also a problem that low-temperature viscosity characteristics are impaired.

An object of the present invention is to provide a lubricating oil composition which has an excellent friction-reducing effect and low-temperature viscosity characteristics while achieving low evaporativity, is excellent in fuel consumption, and is good in solubility with additives, an internal combustion engine using the lubricating oil composition, and a method for lubricating an internal combustion engine with the lubricating oil composition.

Solution to Problem

The present inventors have found that a lubricating oil composition using a mineral oil having a complex viscosity $\eta^*$ at −35° C. of a predetermined value or less and a viscosity index improver containing a comb-shaped polymer, in which the content of a molybdenum-based friction modifier is regulated to a predetermined range, and a NOACK value is regulated to a predetermined value or less, is able to solve the aforementioned problem.

Specifically, the present invention provides the following [1] to [3].

[1] A lubricating oil composition containing a base oil (A) containing a mineral oil (A1) having a complex viscosity $\eta^*$ at −35° C. of 150 Pa·s or less as measured with a rotary rheometer under conditions at an angular velocity of 6.3 rad/s and a strain amount of 0.1%;

a viscosity index improver (B) containing a comb-shaped polymer (B); and a molybdenum-based friction modifier (C), wherein, the content of the molybdenum-based friction modifier (C) in terms of a molybdenum atom is more than 500 ppm by mass and less than 900 ppm by mass on the basis of the whole amount of the lubricating oil composition, and a NOACK value of the lubricating oil composition is 10% by mass or less.

[2] An internal combustion engine including a sliding mechanism equipped with a piston ring and a liner, and the lubricating oil composition as set forth in the above [1].

[3] A method for lubricating an internal combustion engine having a sliding mechanism equipped with a piston ring and a liner, the method including lubricating the piston ring and the liner with the lubricating oil composition as set forth in the above [1].

Advantageous Effects of Invention

The lubricating oil composition of the present invention has an excellent friction-reducing effect and low-temperature viscosity characteristics while achieving low evaporativity and is excellent in fuel consumption. Furthermore, the lubricating oil composition is also good in solubility with additives, and therefore, it is able to effectively reveal the characteristics which the additives have.

BRIEF DESCRIPTION OF DRAWING

FIG. 1 is a schematic view illustrating an outline of a configuration of a sliding mechanism equipped with a piston ring and a liner.

DESCRIPTION OF EMBODIMENTS

In this specification, the values of kinetic viscosity and viscosity index are values measured in conformity with JIS K2283:2000.

In this specification, the values of the mass average molecular weight (Mw) and the number average molecular weight (Mn) of each of the components are each a value in terms of standard polystyrene as measured by the gel permeation chromatography (GPC), specifically, a value measured according to the method described in the section of Examples.

In this specification, for example, the "(meth)acrylate" is used as a terminology expressing both an "acrylate" and a "methacrylate", and other analogous terms or similar expressions are also the same.

[Lubricating Oil Composition]

The lubricating oil composition of the present invention has a NOACK value of 10% by mass or less and is reduced in evaporativity.

As for a lubricating oil composition having a NOACK value of more than 10% by mass, for example, in the case where it is used for an engine mounted with a supercharger, or the like, the evaporation becomes large due to an increase of thermal load. As a result, the amount of oil necessary for lubrication cannot be thoroughly kept, so that breakage of an engine part or the like is liable to be generated.

From the viewpoint of suppressing the aforementioned harmful effects, though the NOACK value of the lubricating oil composition of the present invention is 10% by mass or less, it is preferably 9.9% by mass or less, and more preferably 9.8% by mass or less, and it is preferably 1% by mass or more, more preferably 3% by mass or more, and still more preferably 5% by mass or more.

In this specification, the NOACK value means a value measured in conformity with JPI-5S-41-2004.

The lubricating oil composition of the present invention contains a base oil (A) containing a mineral oil (A1) having a complex viscosity $\eta^*$ at −35° C. of 150 Pa·s or less as measured with a rotary rheometer under conditions at an angular velocity of 6.8 rad/s and a strain amount of 0.1%; a viscosity index improver (B) containing a comb-shaped polymer (B1); and a molybdenum-based friction modifier (C).

The lubricating oil composition according to one embodiment of the present invention may further contain other additive for lubricating oil than those mentioned above.

In the lubricating oil composition according to one embodiment of the present invention, a total content of the components (A), (B), and (C) is preferably 60 to 100% by mass, more preferably 70 to 100% by mass, still more preferably 80 to 100% by mass, and yet still more preferably 85 to 100% by mass on the basis of the whole amount (100% by mass) of the lubricating oil composition.

<Base Oil (A)>

From the viewpoints of improving low-temperature viscosity characteristics and fuel consumption, though the base oil (A) which is contained in the lubricating oil composition of the present invention is one containing a mineral oil (A1) it can also contain a synthetic oil together with the mineral oil (A1).

Examples of the synthetic oil include a poly-α-olefin (PAO), an ester-based compound, an ether-based compound, a polyglycol, an alkylbenzene, and an alkylnaphthalene.

These synthetic oils may be used either alone or in combination of two or more thereof.

From the viewpoints of improving low-temperature viscosity characteristics and fuel consumption, a content proportion of the mineral oil (A1) in the whole amount (100% by mass) of the base oil (A) which is contained in the lubricating oil composition according to one embodiment of the present invention is preferably 70 to 100% by mass, more preferably 80 to 100% by mass, still more preferably 90 to 100% by mass, and yet still more preferably 95 to 100% by mass.

In the lubricating oil composition according to one embodiment of the present invention, the content of the base oil (A) is preferably 55% by mass or more, more preferably 60% by mass or more, still more preferably 65% by mass or more, yet still more preferably 70% by mass or more, and especially preferably 75% by mass or more, and it is preferably 99% by mass or less, and more preferably 95% by mass or less, on the basis of the whole amount (100% by mass) of the lubricating oil composition.

In one embodiment of the present invention, a kinematic viscosity at 100° C. of the base oil (A) is preferably 3.8 to 5.6 $mm^2/s$, more preferably 4.0 to 5.4 $mm^2/s$, still more preferably 4.2 to 5.2 $mm^2/s$, and yet still more preferably 4.4 to 5.0 $mm^2/s$.

In one embodiment of the present invention, a viscosity index of the base oil (A) is preferably 100 or more, more preferably 105 or more, still more preferably 110 or more, and yet still more preferably 120 or more.

<Mineral Oil (A1)>

Examples of the mineral base oil (A1) which is used in the present invention include a topped crude obtained by atmospheric distillation of a crude oil, such as a paraffinic mineral oil, an intermediate mineral oil, and a naphthenic mineral oil; a distillate oil obtained by vacuum distillation of the topped crude; and a mineral oil or a wax (e.g., a slack wax and a GTL wax) obtained by subjecting the distillate oil to at least one purification process, such as solvent deasphalting, solvent extraction, hydrofinishing, solvent dewaxing, catalytic dewaxing, isomerization dewaxing, and vacuum distillation.

The mineral oil (A1) which is used in the present invention may be one composed of a single mineral oil or a mixed oil of a combination of two or more mineral oils.

Here, the mineral oil (A1) which is used in the present invention is a mineral oil satisfying the following requirement (I).

Requirement (I): A complex viscosity $\eta^*$ at −35° C. as measured with a rotary rheometer under conditions at an angular velocity of 6.3 rad/s and a strain amount of 0.1% (hereinafter also referred to simply as "complex viscosity $\eta^*$ at −35° C.") is 150 Pa·s or less.

In this specification, the complex viscosity $\eta^*$ at a predetermined temperature is a value measured under the aforementioned conditions, specifically, a value measured according to the method described in the section of Examples.

In the case where the mineral oil (A1) which is used in the present invention is a mixed oil of a combination of two or more mineral oils, it is enough that the mixed oil satisfies the requirement (I). In addition, so long as the "two or more mineral oils" which are contained in the mixed oil each satisfy the requirement (I), the mixed oil of a combination of these mineral oils can also be considered to be one satisfying the requirement (I).

The "complex viscosity η* at −35° C." prescribed in the requirement (I) is one of indexes exhibiting the low-temperature viscosity characteristics of the mineral oil in a low-temperature environment.

As the complex viscosity η* at −35° C. of the mineral oil is lower, there is a tendency that a straight-chain paraffin content (normal paraffin content) is lower. By using a mineral oil with a low straight-chain paraffin content, a lubricating oil composition with good low-temperature viscosity characteristics may be produced.

The mineral oil with a low straight-chain paraffin content is easy to become good in solubility with additives, such as a molybdenum-based friction modifier, and may be said to be a base oil which is easy to effectively reveal functions of the additives, such as a molybdenum-based friction modifier.

Although the complex viscosity η* at −35° C. of the mineral oil (A1) which is used in the present invention is 150 Pa·s or less, from the aforementioned viewpoints, it is preferably 120 Pa·s or less, more preferably 100 Pa·s or less, still more preferably 80 Pa·s or less, yet still more preferably 60 Pa·s or less, and especially preferably 40 Pa·s or less.

Although the complex viscosity η* at −35° C. of the mineral oil (A1) is not particularly limited with respect to its lower limit value, it is preferably 0.1 Pa·s or more, more preferably 0.5 Pa·s or more, and still more preferably 1.0 Pa·s or more. In particular, from the viewpoint of regulating the NOACK value to a low value to produce a low-evaporativity lubricating oil composition, the complex viscosity η* at −35° C. of the mineral oil (A1) is yet still more preferably 3.5 Pa·s or more, and especially preferably 4.0 Pa·s or more.

In one embodiment of the present invention, from the viewpoint of not only making the low-temperature viscosity characteristics good but also regulating the NOACK value to a low value to produce a low-evaporativity lubricating oil composition, the mineral oil (A1) is preferably a mixed oil containing a mineral oil (A11) having a complex viscosity η* at −35° C. of less than 15 Pa·s and a mineral oil (A12) having a complex viscosity η* at −35° C. of 15 to 150 Pa·s.

The mineral oil (A11) contributes to an improvement of the low-temperature viscosity characteristics of the lubricating oil composition. Meanwhile, the mineral oil (A12) contributes to regulating the NOACK value low to make the lubricating oil composition low in evaporativity.

In the aforementioned mixed oil, from the aforementioned viewpoints, a content ratio of the mineral oil (A11) and the mineral oil (A12) [(A11)/(A12)] is preferably 55/45 to 95/5, more preferably 60/40 to 90/10, still more preferably 65/35 to 85/15, and yet still more preferably 70/30 to 80/20.

The complex viscosity η* at −35° C. of the mineral oil (A11) is preferably 10 Pa·s or less, more preferably 8.0 Pa·s or less, and still more preferably 6.0 Pa·s or less.

Meanwhile, the complex viscosity η* at −35° C. of the mineral oil (A12) is preferably 20 Pa·s or more, and more preferably 25 Pa·s or more, and it is preferably 120 Pa·s or less, more preferably 100 Pa·s or less, still more preferably 80 Pa·s or less, yet still more preferably 60 Pa·s or less, and especially preferably 40 Pa·s or less.

The mineral oil (A1) is preferably a mineral oil satisfying the following requirement (II) together with the requirement (I).

Requirement (II): A temperature gradient Δ|η*| of complex viscosity between two temperature points −10° C. and −25° C. as measured with a rotary rheometer under conditions at an angular velocity of 6.3 rad/s and a strain amount of 0.1 to 100% (hereinafter also referred to simply as "temperature gradient Δ|ηn*| of complex viscosity") is 1.0 Pa·s/° C. or less.

The "strain amount" as prescribed in the requirement (II) is a measurement condition parameter that is appropriately set within a range of from 0.1 to 100% according to the measurement temperature. For example, in the section of Examples as mentioned later, the strain amount was set to "2.1%" in the measurement at −10° C. and "0.4%" in the measurement at −25° C., respectively.

In the case where the mineral oil (A1) which is used in the present invention is a mixed oil of a combination of two or more mineral oils, it is enough that the mixed oil satisfies the requirement (II). In addition, so long as the "two or more mineral oils" which are contained in the mixed oil each satisfy the requirement (II), the mixed oil of a combination of these mineral oils can also be considered to be one satisfying the requirement (II).

The "temperature gradient Δ|η*| of complex viscosity" as prescribed in the requirement (II) is a value indicative of an amount of change (absolute value of a slope) of complex viscosity per unit between two temperature points −10° C. and −25° C. as observed when the value of the complex viscosity η* at −10° C. and the value of the complex viscosity η* at −25° C. as measured either independently at these temperatures or while continuously varying the temperature from −10° C. to −25° C. or from −25° C. to −10° C. are placed on a temperature-complex viscosity coordinate plane. More specifically, the temperature gradient Δ|η*| of complex viscosity means a value calculated from the following calculation formula (f1).

Calculation formula (f1): Temperature gradient Δ|η*| of complex viscosity=|([complex viscosity η* at −25° C.]−[complex viscosity η* at −10° C.])/(−25−(−10))|

Now, a mineral oil contains a wax component, and therefore, when the temperature of the mineral oil is gradually decreased, the wax component precipitates in the mineral oil to form a gelatinous structure. The temperature at which the wax component precipitates is different depending upon the structure of paraffin or the like. The gelatinous structure easily breaks, and the viscosity changes under a mechanical action. Conventionally, physical property parameters exhibiting the low-temperature viscosity characteristics, which are generally adopted, did not consider such precipitation of the wax component.

On the other hand, the "temperature gradient Δ|η*| of complex viscosity" as prescribed in the requirement (II) is an index capable of more accurately evaluating the low-temperature viscosity characteristics of the mineral oil by considering the changes in coefficient of friction following the precipitation of the wax component, while taking into account the precipitation rate of the wax component which is contained in the base oil.

The mineral oil satisfying the requirement (II) is regulated such that the temperature gradient Δ|η*| of complex viscosity is 1.0 Pa·s/° C. or less, and the precipitation rate of the wax component does not become fast, and therefore, it hardly causes an increase of the coefficient of friction and is good in low-temperature viscosity characteristics.

Accordingly, by using a mineral oil satisfying the requirement (II), it is possible to produce a lubricating oil composition having excellent friction-reducing effect and low-temperature viscosity characteristics.

Although the temperature gradient $\Delta|\eta^*|$ of complex viscosity of the mineral oil (A1) as prescribed in the requirement (II) is 1.0 Pa·s/° C. or less, it is preferably 0.8 Pa·s/° C. or less, more preferably 0.6 Pa·s/° C. or less, still more preferably 0.5 Pa·s/C or less, and yet still more preferably 0.4 Pa·s/° C. or less from the aforementioned viewpoints.

Although the temperature gradient $\Delta|\eta q^*|$ of complex viscosity of the mineral oil (A1) as prescribed in the requirement (II) is not particularly limited with respect to its lower limit value, it is preferably 0.001 Pa·s/° C. or more, and more preferably 0.01 Pa·s/° C. or more.

A kinematic viscosity at 100° C. of the mineral oil (A1) is preferably 4 to 8 $mm^2/s$, more preferably 4.05 to 7.9 $mm^2/s$, and still more preferably 4.1 to 7.8 $mm^2/s$.

In one embodiment of the present invention, from viewpoint of regulating the NOACK value to a low value to produce a low-evaporativity lubricating oil composition, the mineral oil (A1) is preferably a mixed oil containing a mineral oil having a kinematic viscosity at 100° C. of less than 7 $mm^2/s$ and a mineral oil having a kinematic viscosity at 100° C. of 7 $mm^2$ or more, and more preferably a mixed oil containing a mineral oil having a kinematic viscosity at 100° C. of 4 $mm^2$ or more and less than 7 $mm^2/s$ and a mineral oil having a kinematic viscosity at 100° C. of 7 $mm^2/s$ or more and 8 $mm^2/s$ or less.

A viscosity index of the mineral oil (A1) is preferably 100 or more, more preferably 105 or more, still more preferably 110 or more, and yet still more preferably 120 or more.

A naphthene content (% $C_N$) of the mineral oil (A1) is preferably 3 to 30, more preferably 4 to 30, still more preferably 5 to 30, and yet still more preferably 6 to 30.

The mineral oil having a naphthene content (% $C_N$) within the aforementioned range easily becomes good in solubility with the molybdenum-based friction modifier.

From the viewpoint of producing a lubricating oil composition with excellent high-temperature piston detergency an aromatic content (% $C_A$) of the mineral oil (A1) is preferably less than 1.0, more preferably less than 0.5, and still more preferably 0.1 or less.

In this specification, the naphthene content (% $C_N$) and the aromatic content (% $C_A$) of the mineral oil (A1) each mean the proportion (percentage) of the naphthene or aromatic component as measured using the ASTM D-3238 ring analysis (n-d-M method).

<Preparation Example of Mineral Oil (A1) Satisfying Requirements (I) and (II)>

The mineral oil (A1) satisfying the requirements (I) and (II) can be easily prepared by appropriately considering the following matters. The following matters merely represent an example of the preparation method, and it is also possible to prepare the mineral oil (A1) by considering matters other than the foregoing matters.

(1) Adjustment of Mass Average Molecular Weight of Mineral Oil (A1)

The mass average molecular weight (Mw) of the mineral oil (A1) is a physical property that affects the properties as prescribed by the requirements (I) and (II).

From the viewpoint of producing the mineral oil (A1) satisfying the requirements (I) and (II), the mass average molecular weight (Mw) of the mineral oil (A1) is preferably 550 or less, and it is preferably 300 or more.

(2) Selection of Feedstock Oil as Feedstock of Mineral Oil (A1)

The feedstock oil as the feedstock of the mineral oil (A1) is preferably a feedstock oil containing a petroleum-derived wax (e.g., a slack wax) or a feedstock oil containing a petroleum-derived wax and a bottom oil. In addition, a feedstock oil containing a solvent dewaxed oil may also be used.

The mineral oil (A1) which is contained in the lubricating oil composition according to one embodiment of the present invention is preferably one obtained by purifying a feedstock oil containing a petroleum-derived wax.

In the case of using a feedstock oil containing a petroleum-derived wax and a bottom oil, a content ratio of the wax and the bottom oil [wax/bottom oil] in the feedstock oil is preferably 50/50 to 99/1, more preferably 60/40 to 98/2, still more preferably 70/30 to 97/3, and yet still more preferably 80/20 to 95/5 in terms of a mass ratio.

As the proportion of the bottom oil in the feedstock oil increases, the value of the complex viscosity $\eta^*$ at −35° C. as prescribed by the requirement (I) and the value of the temperature gradient $\Delta|\eta^*|$ of complex viscosity as prescribed by requirement (II) tend to increase.

On the other hand, the bottom oil contains a lot of the naphthene component, and therefore, a mineral oil having a high naphthene content (% $C_N$) can be prepared by using a feedstock oil containing a bottom oil. The naphthene component in the mineral oil contributes to the high-temperature piston detergency of the lubricating oil composition.

As the bottom oil, there is exemplified a bottom fraction remained after hydrocracking of an oil containing a heavy fuel oil obtained from a vacuum distillation device in a common fuel oil producing process using a crude oil as a feedstock, followed by separation and removal of naphtha and a kerosene-gas oil.

Examples of the wax include, in addition to waxes to be separated after solvent dewaxing of the aforementioned bottom fraction, waxes obtained after solvent dewaxing of a topped crude remained after atmospheric distillation of a crude oil, such as a paraffinic mineral oil, an intermediate mineral oil, and a naphthenic mineral oil; waxes obtained after solvent dewaxing of a distillate oil obtained through vacuum distillation of the topped crude; waxes obtained after solvent dewaxing of the distillate oil having been subjected to solvent deasphalting, solvent extraction, or hydrofinishing; and GTL waxes obtained through the Fischer-Tropsch synthesis.

On the other hand, as the solvent dewaxed oil, there is exemplified a residue after solvent dewaxing of the aforementioned bottom fraction or the like, followed by separation and removal of the aforementioned wax. In addition, the solvent dewaxed oil is one having been subjected to a purification process by solvent dewaxing and is different from the aforementioned bottom oil.

The method for obtaining a wax through solvent dewaxing is preferably a method in which, for example, the bottom fraction is mixed with a mixed solvent of methyl ethyl ketone and toluene, and the precipitate is removed while agitating the mixture in a low temperature region.

From the viewpoint of producing the mineral oil (A1) satisfying the requirements (I) and (II), a specific temperature in the solvent dewaxing in a low-temperature environment is preferably lower than the typical solvent dewaxing temperature. Specifically, the temperature is preferably −25° C. or lower, and more preferably −30° C. or lower.

From the viewpoint of producing the mineral oil (A1) satisfying the requirements (I) and (II), the oil content of the feedstock oil is preferably 5 to 55% by mass, more preferably 7 to 45% by mass, still more preferably 10 to 35% by mass, yet still more preferably 15 to 32% by mass, and especially preferably 21 to 30% by mass.

(3) Setting of Purification Conditions for Feedstock Oil

Preferably, the feedstock oil is subjected to a purification process.

Preferably, the purification process includes at least one of a hydrogenation isomerization dewaxing process and a hydrogenation process. Preferably, the type of the purification process and the purification conditions are appropriately set according to the kind of the feedstock oil to be used.

More specifically, from the viewpoint of producing the mineral oil (A1) satisfying the requirements (I) and (II), it is preferred to select a purification process according to the kind of the feedstock oil to be used in the following manner.

In the case of using a feedstock oil (α) containing a petroleum-derived wax and a bottom oil in the aforementioned content ratio, it is preferred that the feedstock oil (α) is subjected to a purification process including both a hydrogenation isomerization dewaxing process and a hydrogenation process.

In the case of using a feedstock oil (β) containing a solvent dewaxed oil, it is preferred that the feedstock oil (β) is subjected to a purification process including a hydrogenation process without performing a hydrogenation isomerization dewaxing process.

The feedstock oil (α) contains a bottom oil, and therefore, the contents of aromatic, sulfur, and nitrogen components tend to increase. The presence of the aromatic, sulfur, and nitrogen components becomes a factor that generates a deposit in producing a lubricating oil composition and causes a lowering of the high-temperature piston washing performance.

By performing the hydrogenation isomerization dewaxing process, it is possible to contemplate to remove the aromatic, sulfur, and nitrogen components, thereby reducing the contents of these components.

According to the hydrogenation isomerization dewaxing process, the straight-chain paraffin in the wax is converted into a branched-chain isoparaffin, thereby making the mineral oil (A1) satisfying the requirements (I) and (II) easy to be produced.

On the other hand, though the feedstock oil (β) contains a wax, the straight-chain paraffin is separated and removed through precipitation in a low-temperature environment in a solvent dewaxing process, and therefore, the content of the straight-chain paraffin that affects the value of the complex viscosity as prescribed by the requirements (I) and (II) is small. Accordingly, there is less need to perform the "hydrogenation isomerization dewaxing process".

(Hydrogenation Isomerization Dewaxing Process)

The hydrogenation isomerization dewaxing process is a purification process that is performed for purposes of isomerizing the straight-chain paraffin contained in the feedstock oil into a branched-chain isoparaffin, ring-opening the aromatic component to transform it into a paraffin component, and removing impurities, such as sulfur component and nitrogen component, and so on, as mentioned above. In particular, the presence of the straight-chain paraffin is one of factors that increase the value of the temperature gradient $\Delta|\eta^*|$ of complex viscosity prescribed by requirement (II). Therefore, according to this process, the value of the temperature gradient $\Delta|\eta^*|$ of complex viscosity is adjusted low through isomerization of the straight-chain paraffin into a branched-chain isoparaffin.

Preferably, the hydrogenation isomerization dewaxing process is performed in the presence of a hydrogenation isomerization dewaxing catalyst.

Examples of the hydrogenation isomerization dewaxing catalyst include catalysts with a metal oxide of nickel (Ni)/tungsten (W), nickel (NO/molybdenum (Mo), cobalt (Co)/molybdenum (Mo), etc., or a noble metal, such as platinum (Pt) and lead (Pd), supported on a carrier, such as silicoaluminophosphate (SAPO) and zeolite.

From the viewpoint of producing the mineral oil (A1) satisfying the requirements (I) and (II), a hydrogen partial pressure in the hydrogenation isomerization dewaxing process is preferably 2.0 to 220 MPa, more preferably 2.5 to 100 MPa, still more preferably 3.0 to 50 MPa, and yet still more preferably 3.5 to 25 MPa.

From the viewpoint of producing the mineral oil (A1) satisfying the requirements (I) and (II), a reaction temperature in the hydrogenation isomerization dewaxing process is preferably set to a temperature higher than the reaction temperature of a common hydrogenation isomerization dewaxing process, and specifically, it is preferably 320 to 480° C., more preferably 325 to 420° C., still more preferably 330 to 400° C., and yet still more preferably 340 to 370° C.

When the reaction temperature is a high temperature, the isomerization of the straight-chain paraffin existent in the feedstock oil into a branched-chain isoparaffin can be promoted, whereby it becomes easy to prepare the mineral oil (A1) satisfying the requirement (I) and (II).

From the viewpoint of producing the mineral oil (A1) satisfying the requirements (I) and (II), a liquid hourly space velocity (LHSV) in the hydrogenation isomerization dewaxing process is preferably 5.0 $hr^{-1}$ or less, more preferably 2.0 $hr^{-1}$ or less, still more preferably 1.0 $hr^{-1}$ or less, and yet still more preferably 0.6 $hr^{-1}$ or less.

From the viewpoint of improving the productivity, the LHSV in the hydrogenation isomerization dewaxing process is preferably 0.1 $hr^{-1}$ or more, and more preferably 0.2 $hr^{-1}$ or more.

A supply proportion of the hydrogen gas in the hydrogenation isomerization dewaxing process is preferably 100 to 1,000 $Nm^3$, more preferably 200 to 800 $Nm^3$, and still more preferably 250 to 650 $Nm^3$ per kiloliter of the feedstock oil to be supplied.

The generated oil after the hydrogenation isomerization dewaxing process may be subjected to vacuum distillation for the purpose of removing the light fraction.

(Hydrogenation Process)

The hydrogenation process is a purification process that is performed for purposes of complete saturation of the aromatic component contained in the feedstock oil, removal of impurities, such as the sulfur component and the nitrogen component, and so on.

Preferably, the hydrogenation process is performed in the presence of a hydrogenation catalyst.

Examples of the hydrogenation catalyst include catalysts with a metal oxide of nickel (Ni)/tungsten (W), nickel (Ni)/molybdenum (Mo), cobalt (Co)/molybdenum (Mo), etc., or a noble metal, such as platinum (Pt) and lead (Pd), supported on an amorphous carrier, such as silica/alumina, alumina, etc., or a crystalline carrier, such as zeolite.

From the viewpoint of producing the mineral oil (A1) satisfying the requirements (I) and (II), a hydrogen partial pressure in the hydrogenation process is preferably set to a pressure higher than the pressure of a common hydrogenation process, and specifically, it is preferably 16 MPa or more, more preferably 17 MPa or more, and still more preferably 20 MPa or more, and it is preferably 30 MPa or less, and more preferably 22 MPa or less.

From the viewpoint of producing the mineral oil (A1) satisfying the requirements (I) and (II), a reaction temperature in the hydrogenation process is preferably 200 to 400° C., more preferably 250 to 360° C., and still more preferably 280 to 330° C.

From the viewpoint of producing the mineral oil (A1) satisfying the requirements (I) and (II), a liquid hourly space velocity (LHSV) in the hydrogenation process is preferably 5.0 $hr^{-1}$ or less, more preferably 2.0 $hr^{-1}$ or less, and still more preferably 1.0 $hr^{-1}$ or less, and from the viewpoint of productivity, it is preferably 0.1 $hr^{-1}$ or more, more preferably 0.2 $hr^{-1}$ or more, and still more preferably 0.3 $hr^{-1}$ or more.

A supply proportion of the hydrogen gas in the hydrogenation process is preferably 100 to 1,000 $Nm^3$, more preferably 200 to 800 $Nm^3$, and still more preferably 250 to 650 $Nm^3$ per kiloliter of the supplied oil to be processed.

The generated oil after the hydrogenation process may be subjected to vacuum distillation for the purpose of removing the light fraction. Various conditions of the vacuum distillation (e.g., pressure, temperature, and time) are appropriately adjusted so as to make the kinetic viscosity at 100° C. of the mineral oil (A1) fall within a desirable range.

<Viscosity Index Improver (B)>

The lubricating oil composition of the present invention contains the viscosity index improver (B) containing a comb-shaped polymer (B).

In accordance with the investigations made by the present inventors, it has been noted that when containing the comb-shaped polymer (B1) as the viscosity index improver (B) together with the mineral oil (A1), the solubility of the molybdenum-based friction modifier (C) in the base oil (A) can be more improved, as compared with of blending a polymethacrylate or olefinic copolymer that is a general viscosity index improver.

In the case of using a polymethacrylate that is a general viscosity index improver, or the like, a high-temperature high-shear (HTHS) viscosity of the obtained lubricating oil composition is liable to increase, and there is a concern about a lowering of the fuel consumption.

On the other hand, in the lubricating oil composition of the present invention, by using the comb-shaped polymer (B1) as the viscosity index improver, the increase of the HTHS viscosity is suppressed, whereby the excellent fuel consumption can be revealed.

The viscosity index improver (B) that is used in one embodiment of the present invention may contain a viscosity index improver composed of other resin component not corresponding to the comb-shaped polymer (B1), or the unreacted raw materials and catalyst used at the time of synthesis of the comb-shaped polymer (B1) as well as a by-product, such as a resin component as formed at the time of synthesis, which is not corresponding to the comb-shaped polymer, within a range where the effects of the present invention are not impaired.

In this specification, the aforementioned "resin component" means a polymer having a mass average molecular weight (Mw) of 1,000 or more and having a fixed repeating unit.

Examples of the viscosity index improver composed of other resin component not corresponding to the comb-shaped polymer (B1) include a polymethacrylate, a dispersion type polymethacrylate, an olefin-based copolymer (for example, an ethylene-propylene copolymer), a dispersion type olefin-based copolymer, and a styrenic copolymer (for example, a styrene-diene copolymer and a styrene-isoprene copolymer).

The content of the aforementioned by-product is preferably 10% by mass or less, more preferably 5% by mass or less, still more preferably 1% by mass or less, and yet still more preferably 0.1% by mass or less on the basis of the whole amount (100% by mass) of the solid component in the viscosity index improver (B).

The aforementioned "solid component in the viscosity index improver (B)" means a component in which a diluent oil is eliminated from the viscosity index improver (B) and includes not only the comb-shaped polymer (B1) but also other resin component or by-product not corresponding to the comb-shaped polymer (B1).

The viscosity index improver (B) that is used in one embodiment of the present invention is one containing the comb-shaped polymer (B1). However, in general, taking into consideration handling properties and solubility in the base oil (A), in many cases, viscosity index improvers are put on the market in a form of a solution in which the solid component containing a resin, such as the comb-shaped polymer (B1), etc., is dissolved with a diluent oil, such as a mineral oil and a synthetic oil.

In the case where the viscosity index improver (B) is in a form of the solution, the solid component concentration of the solution is typically 5 to 30% by mass on the basis of the whole amount (100% by mass) of the solution.

In the lubricating oil composition according to one embodiment of the present invention, from the viewpoint of improving the solubility of the molybdenum-based friction modifier (C) as well as the viewpoint of producing a lubricating oil composition with excellent fuel consumption, the content of the viscosity index improver (B) is preferably 0.1 to 3.2% by mass, more preferably 0.2 to 3.0% by mass, still more preferably 0.5 to 2.7% by mass, and yet still more preferably 1.0 to 2.4% by mass on the basis of the whole amount (100% by mass) of the lubricating oil composition.

The lubricating oil composition of the present invention uses the mineral oil (A1) satisfying the requirement (I), and therefore, the functions of additives are easy to be effectively revealed, and the content of the viscosity index improver (B) can be controlled to a small amount. As a result, it is possible to produce a lubricating oil composition which controls the increase of the HTHS viscosity and is excellent in fuel consumption.

In this specification, the aforementioned "content of the viscosity index improver (B)" is a solid component amount including the comb-shaped polymer (B1) and the aforementioned other resin component but not including the mass of the diluent oil.

From the viewpoint of improving the solubility of the molybdenum-based friction modifier (C) as well as the viewpoint of producing a lubricating oil composition with excellent fuel consumption, a content proportion of the comb-shaped polymer (B1) in the whole amount (solid component amount, 100% by mass) of the viscosity index improver (B) which is contained in the lubricating oil composition according to one embodiment of the present invention is preferably 70 to 100% by mass, more preferably 80 to 100% by mass, still more preferably 85 to 100% by mass, and yet still more preferably 90 to 100% by mass.

<Comb-Shaped Polymer (B1)>

In the present invention, the "comb-shaped polymer" refers to a polymer having a structure having a large number of trigeminal branch points from which a high-molecular weight side chain comes out in a main chain thereof.

From the viewpoint of improving the fuel consumption performance, a mass average molecular weight (Mw) of the comb-shaped polymer (B1) is preferably 10,000 to 1,000,000, more preferably 50,000 to 950,000, still more preferably 100,000 to 900,000, yet still more preferably 200,000 to 850,000, and especially preferably 350,000 to 700,000.

From the viewpoint of improving the fuel consumption performance of the lubricating oil composition, a molecular weight distribution (Mw/Mn) of the comb-shaped polymer (B1) (Mw represents a mass average molecular weight of the comb-shaped polymer (B1), and Mn represents a number average molecular weight of the comb-shaped polymer (B1)) is preferably 8.00 or less, more preferably 7.00 or less, still more preferably 6.50 or less, yet still more preferably 6.00 or less, even yet still more preferably 5.00 or less, and even still more preferably 3.00 or less. As the molecular weight distribution of the comb-shaped polymer (B1) is smaller, the fuel consumption performance of the lubricating oil composition containing the comb-shaped polymer (B1) together with the base oil tends to be more improved.

Although the molecular weight distribution of the comb-shaped polymer (B1) is not particularly limited with respect to its lower limit value, it is typically 1.01 or more, preferably 1.05 or more, and more preferably 1.10 or more.

In the lubricating oil composition according to one embodiment of the present invention, from the viewpoint of improving the solubility of the molybdenum-based friction modifier (C) as well as the viewpoint of producing a lubricating oil composition with excellent fuel consumption, the content of the comb-shaped polymer (B1) is preferably 0.1 to 3.2% by mass, more preferably 0.2 to 3.0% by mass, still more preferably 0.5 to 2.7% by mass, and yet still more preferably 1.0 to 2.4% by mass on the basis of the whole amount (100% by mass) of the lubricating oil composition.

In the lubricating oil composition of the present invention, even when the content of the comb-shaped polymer (B1) is relatively small, by combining together with the mineral oil (A1), the solubility of an additive, such as the molybdenum-based friction modifier (C), can be improved. Then, the content of the comb-shaped polymer (B1) can be controlled to a small amount, and therefore, it is possible to produce a lubricating oil composition which controls the increase of the HTHS viscosity and is excellent in fuel consumption.

From the viewpoint of improving the fuel consumption performance in a low-temperature region on the supposition of the engine start-up time, SSI (shear stability index) of the comb-shaped polymer (B1) is preferably 30 or less, more preferably 25 or less, still more preferably 20 or less, and yet still more preferably 15 or less.

Although the SSI of the comb-shaped polymer (B1) is not particularly limited with respective to its lower limit value, it is typically 0.1 or more, and preferably 0.2 or more.

In this specification, the SSI (shear stability index) of the comb-shaped polymer (B1) expresses a percentage of a lowering of the viscosity by shearing originated from the resin component in the comb-shaped polymer (B1) and is a value as measured in conformity with ASTM D6278. More specifically, the SSI is a value as calculated according to the following calculation formula (1).

$$SSI = \frac{Kv_0 - Kv_1}{Kv_0 - Kv_{oil}} \times 100 \quad (1)$$

In the formula (1), $Kv_0$ represents a value of kinematic viscosity at 100° C. of a sample oil obtained by diluting the resin component-containing viscosity index improver in a mineral oil; and $Kv_1$ represents a value of kinematic viscosity at 100° C. after passing a sample oil obtained by diluting the viscosity index improver containing the foregoing resin component in a mineral oil through a high-shear Bosch diesel injector for 30 cycles according to the procedures of ASTM D6278. In addition, $Kv_{oil}$ denotes a value of kinematic viscosity at 100° C. of the mineral oil used on the occasion of diluting the viscosity index improver.

The value of SSI of the comb-shaped polymer (B1) varies with the structure of the comb-shaped polymer (B1). Specifically, there are the following tendencies, and by considering these matters, the value of SSI of the comb-shaped polymer (B1) can be easily regulated. The following matters merely represent an example to the bitter end, and it is also possible to make regulations by considering matters different from the following matters.

The side chain of the comb-shaped polymer is constituted of a macromonomer (x1), and as the content of a constituent unit (X1) derived from the macromonomer (x1) is larger, the value of SSI of the comb-shaped polymer tends to become low.

As the molecular weight of side chain of the comb-shaped polymer is higher, the value of SSI tends to become low.

As the comb-shaped polymer (B1), a polymer having at least the constituent unit (X1) derived from the macromonomer (x1) is preferred. This constituent unit (X1) is corresponding to the aforementioned "high-molecular weight side chain".

In the present invention, the aforementioned "macromonomer" means a high-molecular weight monomer having a polymerizable functional group and is preferably a high-molecular weight monomer having a polymerizable functional group in an end thereof.

A number average molecular weight (Mn) of the macromonomer (x1) is preferably 200 or more, more preferably 300 or more, still more preferably 400 or more, yet still more preferably 500 or more, even yet still more preferably 600 or more, and even still more preferably 700 or more, and it is preferably 200,000 or less, more preferably 100,000 or less, still more preferably 60,000 or less, and yet still more preferably 20,000 or less.

Examples of the polymerizable functional group which the macromonomer (x1) has include an acryloyl group ($CH_2{=}CH{-}COO{-}$), a methacryloyl group ($CH_2{=}CCH_3{-}COO{-}$), an ethenyl group ($CH_2{=}CH{-}$), a vinyl ether group ($CH_2{=}CH{-}O{-}$), an allyl group ($CH_2{=}CH{-}CH_2{-}$), an allyl ether group ($CH_2{=}CH{-}CH_2{-}O{-}$), a group represented by $CH_2{=}CH{-}CONH{-}$, and a group represented by $CH_2{=}CCH_3{-}CONH{-}$.

The macromonomer (x1) may also have at least one selected from repeating units represented by the following general formulae (i) to (iii) in addition to the aforementioned polymerizable functional groups.

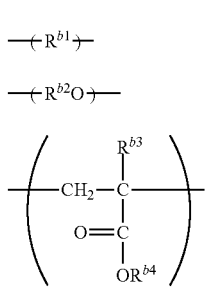

(i)

(ii)

(iii)

In the general formula (i), $R^{b1}$ represents a linear or branched chain alkylene group having a carbon number of 1 to 10, and specifically, examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, and a 2-ethylhexylene group.

In the general formula (ii), $R^{b2}$ represents a linear or branched chain alkylene group having a carbon number of 2 to 4, and specifically, examples thereof include an ethylene group, a 1,2-propylene group, a 1,3-propylene group, a 1,2-butylene group, a 1,3-butylene group, and a 1,4-butylene group.

In the general formula (iii), $R^{b3}$ represents a hydrogen atom or a methyl group.

$R^{b4}$ represents a linear or branched chain alkyl group having a carbon number of 1 to 10, and specifically, examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, and an isodecyl group.

In the case where the macromonomer (x1) has a plurality of repeating units represented by each of the general formulae (i) to (iii), $R^{b1}$, $R^{b2}$, $R^{b3}$, and $R^{b4}$ may be each the same as or different from each other.

In the case where the macromonomer (x1) is a copolymer having two or more repeating units selected from the general formulae (i) to (iii), the mode of the copolymer may be a block copolymer or may be a random copolymer.

The comb-shaped polymer (B1) that is used in one embodiment of the present invention may be a homopolymer composed of only the constituent unit (X1) derived from one kind of the macromonomer (x1) or may be a copolymer containing the constituent unit (X1) derived from two or more kinds of the macromonomer (x1).

In addition, the comb-shaped polymer (B1) that is used in one embodiment of the present invention may also be a copolymer containing the constituent unit derived from the macromonomer (x1) as well as a constituent unit (X2) derived from other monomer (x2) than the macromonomer (x1).

As a specific structure of such a comb-shaped polymer, a copolymer having a side chain containing the constituent unit (X1) derived from the macromonomer (x1) relative to the main chain including the constituent unit (X2) derived from the monomer (x2) is preferred.

Examples of the monomer (x2) include a monomer (x2-a) represented by the following general formula (a1), an alkyl (meth)acrylate (x2-b), a nitrogen atom-containing vinyl monomer (x2-c), a hydroxy group-containing vinyl monomer (x2-d), a phosphorus atom-containing monomer (x2-e), an aliphatic hydrocarbon-based vinyl monomer (x2-f), an alicyclic hydrocarbon-based vinyl monomer (x2-g), a vinyl ester (x2-h), a vinyl ether (x2-i), a vinyl ketone (x2-j), an epoxy group-containing vinyl monomer (x2-k), a halogen element-containing vinyl monomer (x2-l), an ester of unsaturated polycarboxylic acid (x2-m), a (di)alkyl fumarate (x2-n), a (di)alkyl maleate (x2-o), and an aromatic hydrocarbon-based vinyl monomer (x2-p).

As the monomer (x2), the monomers other than the phosphorus atom-containing monomer (x2-e) and the aromatic hydrocarbon-based vinyl monomer (x2-p) are preferred.

(Monomer (x2-a) Represented by the Following General Formula (a1))

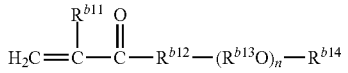

(a1)

In the general formula (a1), $R^{b11}$ represents a hydrogen atom or a methyl group.

$R^{b12}$ represents a single bond, a linear or branched alkylene group having a carbon number of 1 to 10, —O—, or —NH—.

$R^{b13}$ represents a linear or branched alkylene group having a carbon number of 2 to 4. In addition, n represents an integer of 1 or more (preferably an integer of 1 to 20, and more preferably an integer of 1 to 5). In the case where n is an integer of 2 or more, plural $R^{b13}$'s may be the same as or different from each other, and furthermore, the $(R^{b13}O)_n$ moiety may be either a random bond or a block bond.

$R^{b14}$ represents a linear or branched alkyl group having a carbon number of 1 to 60 (preferably 10 to 50, and more preferably 20 to 40).

Specific groups of the aforementioned "linear or branched alkylene group having a carbon number of 1 to 10", "linear or branched alkylene group having a carbon number of 2 to 4", and "linear or branched alkyl group having a carbon number of 1 to 60" include the same groups as those exemplified in the descriptions regarding the aforementioned general formulae (i) to (iii).

(Alkyl (meth)acrylate (x2-b))

Examples of the alkyl(meth)acrylate (x2-b) include methyl (meth)acrylate, ethyl (meth)acrylate, n-propyl (meth)acrylate, isopropyl (meth)acrylate, n-butyl (meth) acrylate, t-butyl (meth)acrylate, pentyl (meth)acrylate, hexyl (meth)acrylate, 2-ethylhexyl (meth)acrylate, heptyl (meth) acrylate, 2-t-butylheptyl (meth)acrylate, octyl (meth)acrylate, and 3-isopropylheptyl (meth)acrylate.

The carbon number of the alkyl group which the alkyl (meth)acrylate (x2-b) has is preferably 1 to 30, more preferably 1 to 26, and still more preferably 1 to 10.

(Nitrogen Atom-Containing Vinyl Monomer (x2-c))

Examples of the nitrogen atom-containing vinyl monomer (x2-c) include an amide group-containing vinyl monomer (x2-c1), a nitro group-containing monomer (x2-c2), a primary amino group-containing vinyl monomer (x2-c3), a secondary amino group-containing vinyl monomer (x2-c4), a tertiary amino group-containing vinyl monomer (x2-c5), and a nitrile group-containing vinyl monomer (x2-6).

Examples of the amide group-containing vinyl monomer (x2-c1) include (meth)acrylamide; monoalkylamino (meth) acrylamides, such as N-methyl (meth)acrylamide, N-ethyl (meth)acrylamide, N-isopropyl (meth)acrylamide, and N-n- or isobutyl (meth)acrylamide; monoalkylaminoalkyl (meth) acrylamides, such as N-methylaminoethyl (meth)acrylamide, N-ethylaminoethyl (meth)acrylamide, N-isopropylamino-n-butyl (meth)acrylamide, and N-n- or isobutylamino-n-butyl (meth)acrylamide; dialkylamino (meth)acrylamides, such as N,N-dimethyl (meth)acrylamide, N,N-diethyl (meth)acrylamide, N,N-diisopropyl (meth) acrylamide, and N,N-di-n-butyl (meth)acrylamide; dialkylaminoalkyl (meth)acrylamides, such as N,N-dimethylaminoethyl (meth)acrylamide, N,N-diethylaminoethyl (meth)acrylamide, N,N-dimethylaminopropyl (meth)acrylamide, and N,N-di-n-butylaminobutyl (meth)acrylamide; and N-vinylcarboxylic acid amides, such as N-vinylformamide, N-vinylacetamide, N-vinyl-n- or isopropionylamide, and N-vinylhydroxyacetamide.

Examples of the nitro group-containing monomer (x2-c2) include nitroethylene and 3-nitro-1-propene.

Examples of the primary amino group-containing vinyl monomer (x2-c3) include alkenylamines having an alkenyl group having a carbon number of 3 to 6, such as (meth) allylamine and crotylamine; and aminoalkyl (meth)acrylates having an alkyl group having a carbon number of 2 to 6, such as aminoethyl (meth)acrylate.

Examples of the secondary amino group-containing vinyl monomer (x2-c4) include monoalkylaminoalkyl (meth) acrylates, such as t-butylaminoethyl (meth)acrylate and methylaminoethyl (meth)acrylate; and dialkenylamines having a carbon number of 6 to 12, such as di(meth)allylamine.

Examples of the tertiary amino group-containing vinyl monomer (x2-c5) include dialkylaminoalkyl (meth)acrylates, such as dimethylaminoethyl (meth)acrylate and diethylaminoethyl (meth)acrylate; alicyclic (meth)acrylates having a nitrogen atom, such as morpholinoethyl (meth) acrylate; and hydrochlorides, sulfates, phosphates, or lower alkyl (carbon number: 1 to 8) monocarboxylic acid (e.g., acetic acid and propionic acid) salts thereof.

Examples of the nitrile group-containing vinyl monomer (x2-c6) include (meth)acrylonitrile.

(Hydroxy Group-Containing Vinyl Monomer (x2-d))

Examples of the hydroxy group-containing vinyl monomer (x2-d) include a hydroxy group-containing vinyl monomer (x2-dl) and a polyoxyalkylene chain-containing vinyl monomer (x2-d2).

Examples of the hydroxy group-containing vinyl monomer (x2-dl) include hydroxyalkyl (meth)acrylates having an alkyl group having a carbon number of 2 to 6, such as 2-hydroxyethyl (meth)acrylate and 2- or 3-hydroxypropyl (meth)acrylate; mono- or di-hydroxyalkyl-substituted (meth)acrylamides having an alkyl group having a carbon number of 1 to 4, such as N,N-dihydroxymethyl (meth) acrylamide, N,N-dihydroxypropyl (meth)acrylamide, and N,N-di-2-hydroxybutyl (meth)acrylamide; vinyl alcohol; alkenols having a carbon number of 3 to 12, such as (meth)allyl alcohol, crotyl alcohol, isocrotyl alcohol, 1-octenol, and 1-undecenol; alkene monools or alkene diols each having a carbon number of 4 to 12, such as 1-buten-3-ol, 2-buten-1-ol, and 2-butene-1,4-diol; hydroxyalkyl alkenyl ethers having an alkyl group having a carbon number of 1 to 6 and an alkenyl group having a carbon number of 3 to 10, such as 2-hydroxyethyl propenyl ether; and alkenyl ethers or (meth)acrylates of a polyhydric alcohol, such as glycerin, pentaerythritol, sorbitol, sorbitan, diglycerin, a sugar, and sucrose.

Examples of the polyoxyalkylene chain-containing vinyl monomer (x2-d2) include a polyoxyalkyene glycol (carbon number of the alkylene group: 2 to 4, degree of polymerization: 2 to 50), a polyoxyalkylene polyol (polyoxyalkylene ether of the aforementioned polyhydric alcohol (carbon number of the alkylene group: 2 to 4, degree of polymerization: 2 to 100)), a mono(meth)acrylate of an alkyl ether (carbon number: 1 to 4) of a polyoxyalkylene glycol or polyoxyalkylene polyol [e.g., polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mole)(meth)acrylate, and mono(meth) acrylic acid polyoxyethylene (Mn: 160 to 230) sorbitan, etc.].

(Phosphorus Atom-Containing Monomer (x2-e))

Examples of the phosphorus atom-containing monomer (x2-e) include a phosphate ester group-containing monomer (x2-e1) and a phosphono group-containing monomer (x2-e2).

Examples of the phosphate ester group-containing monomer (x2-e1) include (meth)acryloyloxyalkyl phosphates having an alkyl group having a carbon number of 2 to 4, such as (meth)acryloyloxyethyl phosphate and (meth)acryloyloxyisopropyl phosphate; and alkenyl phosphates having an alkenyl group having a carbon number of 2 to 12, such as vinyl phosphate, allyl phosphate, propenyl phosphate, isopropenyl phosphate, butenyl phosphate, pentenyl phosphate, octenyl phosphate, decenyl phosphate, and dodecenyl phosphate.

Examples of the phosphono group-containing monomer (x2-e2) include (meth)acryloyloxyalkyl phosphonates having an alkyl group having a carbon number of 2 to 4, such as (meth)acryloyloxyethyl phosphonate; and alkenyl phosphonates having an alkenyl group having a carbon number of 2 to 12, such as vinyl phosphonate, allyl phosphonate, and octenyl phosphonate.

(Aliphatic Hydrocarbon-Based Vinyl Monomer (x2-f)

Examples of the aliphatic hydrocarbon-based vinyl monomer (x2-f) include alkenes having a carbon number of 2 to 20, such as ethylene, propylene, butene, isobutylene, pentene, heptene, diisobutylene, octene, dodecene, and octadecene; and alkadienes having a carbon number of 4 to 12, such as butadiene, isoprene, 1,4-pentadiene, 1,6-heptadiene, and 1,7-octadiene.

The carbon number of the aliphatic hydrocarbon-based vinyl monomer (x2-f) is preferably 2 to 30, more preferably 2 to 20, and still more preferably 2 to 12.

(Alicyclic Hydrocarbon-Based Vinyl Monomer (x2-g))

Examples of the alicyclic hydrocarbon-based vinyl monomer (x2-g) include cyclohexene, (di)cyclopentadiene, pinene, limonene, vinylcyclohexene, and ethylidene bicycloheptene.

The carbon number of the alicyclic hydrocarbon-based vinyl monomer (x2-g) is preferably 3 to 30, more preferably 3 to 20, and still more preferably 3 to 12.

(Vinyl Ester (x2-h))

Examples of the vinyl ester (x2-h) include vinyl esters of a saturated fatty acid having a carbon number of 2 to 12, such as vinyl acetate, vinyl propionate, vinyl butyrate, and vinyl octanoate.

(Vinyl Ether (x2-i))

Examples of the vinyl ether (x2-0 include alkyl vinyl ethers having a carbon number of 1 to 12, such as methyl vinyl ether, ethyl vinyl ether, propyl vinyl ether, butyl vinyl ether, and 2-ethylhexyl vinyl ether; and alkoxyalkyl vinyl ethers having a carbon number of 1 to 12, such as vinyl-2-methoxyethyl ether and vinyl-2-butoxyethyl ether.

(Vinyl Ketone (x2-j))

Examples of the vinyl ketone (x2-j) include alkyl vinyl ketones having a carbon number of 1 to 8 such as methyl vinyl ketone and ethyl vinyl ketone.

(Epoxy Group-Containing Vinyl Monomer (x2-k))

Examples of the epoxy group-containing vinyl monomer (x2-k) include glycidyl (meth)acrylate and glycidyl (meth) allyl ether.

(Halogen Element-Containing Vinyl Monomer (x2-l))

Examples of the halogen element-containing vinyl monomer (x2-l) include vinyl chloride, vinyl bromide, vinylidene chloride, and (meth)allyl chloride.

(Ester of Unsaturated Polycarboxylic Acid (x2-m))

Examples of the ester of unsaturated polycarboxylic acid (x2-m) include an alkyl ester of an unsaturated polycarboxylic acid, a cycloalkyl ester of an unsaturated polycarboxylic acid, and an aralkyl ester of an unsaturated polycarboxylic acid; and examples of the unsaturated carboxylic acid include maleic acid, fumaric acid, and itaconic acid.

((Di)alkyl Fumarate (x2-n))

Examples of the (di)alkyl fumarate (x2-n) include monomethyl fumarate, dimethyl fumarate, monoethyl fumarate, diethyl fumarate, methylethyl fumarate, monobutyl fumarate, dibutyl fumarate, dipentyl fumarate, and dihexyl fumarate.

((Di)alkyl Maleate (x2-o))

Examples of the (di)alkyl maleate (x2-o) include monomethyl maleate, dimethyl maleate, monoethyl maleate, diethyl maleate, methylethyl maleate, monobutyl maleate, and dibutyl maleate.

(Aromatic Hydrocarbon-Based Vinyl Monomer (x2-p))

Examples of the aromatic hydrocarbon-based vinyl monomer (x2-p) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, and 2-vinylnaphthalene.

The carbon number of the aromatic hydrocarbon-based vinyl monomer (x2-p) is preferably 8 to 30, more preferably 8 to 20, and still more preferably 8 to 18.

<Molybdenum-Based Friction Modifier (C)>

The lubricating oil composition of the present invention contains the molybdenum-based friction modifier (C), and the content of the molybdenum-based friction modifier (C) in terms of a molybdenum atom is regulated such that it is more than 500 ppm by mass and less than 900 ppm by mass on the basis of the whole amount (100% by mass) of the lubricating oil composition.

When the content of the molybdenum-based friction modifier (C) in terms of a molybdenum atom is 500 ppm by mass or less, the friction-reducing effect of the obtained lubricating oil composition becomes insufficient.

On the other hand, when the content of the molybdenum-based friction modifier (C) in terms of a molybdenum atom is 900 ppm by mass or more, the molybdenum-based friction modifier (C) is hardly thoroughly dissolved and is liable to precipitate, thereby causing harmful effects.

The lubricating oil composition of the present invention uses the mineral oil (A1) satisfying the requirement (I), and therefore, the functions of additives are easy to be effectively revealed. Namely, even when the content of the molybdenum-based friction modifier (C) is small, the excellent friction-reducing effect can be revealed.

In the lubricating oil composition according to the present invention, from the viewpoint of improving the friction-reducing effect, the content of the molybdenum-based friction modifier (C) in terms of a molybdenum atom is preferably 530 ppm by mass or more, more preferably 550 ppm by mass or more, still more preferably 580 ppm by mass or more, and yet still more preferably 600 ppm by mass or more, and from the viewpoint of suppressing precipitation of the molybdenum-based friction modifier (C), it is preferably 880 ppm by mass or less, more preferably 850 ppm by mass or less, and still more preferably 820 ppm by mass or less, and yet still more preferably 800 ppm by mass or less, on the basis of the whole amount (100% by mass) of the lubricating oil composition.

In this specification, the content of the molybdenum atom means a value measured in conformity with JPI-S-38-92.

In the lubricating oil composition according to the present invention, the content of the molybdenum-based friction modifier (C) in terms of a molybdenum atom is preferably 1.0 to 10.0 parts by mass, more preferably 1.5 to 7.6 parts by mass, still more preferably 2.0 to 6.0 parts by mass, and yet still more preferably 2.5 to 5.0 parts by mass based on 100 parts by mass of the comb-shaped polymer (B1).

When the content of the molybdenum-based friction modifier (C) falls within the aforementioned range, not only the friction-reducing effect can be improved, but also the precipitation of the molybdenum-based friction modifier (C) can be effectively suppressed.

As the molybdenum-based friction modifier (C), though any organic compounds having a molybdenum atom are usable, molybdenum dithiophosphate (MoDTP) and molybdenum dithiocarbamate (MoDTC) are preferred from the viewpoint of improving the friction-reducing effect.

The molybdenum-based friction modifier (C) may be used either alone or in combination of two or more thereof.

As the molybdenum dithiophosphate (MoDTC), a compound represented by the following general formula (c1-1) or a compound represented by the following general formula (c1-2) is preferred, (c1-1)

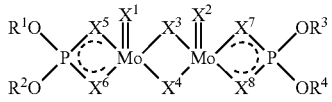

(c1-2)

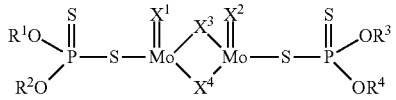

In the general formulae (c1-1) and (c1-2), $R^1$ to $R^4$ each independently represent a hydrocarbon group, and may be the same as or different from each other.

$X^1$ to $X^8$ each independently represent an oxygen atom or a sulfur atom, and may be the same as or different from each other, provided that at least two of $X^1$ to $X^8$ in the general formula (c1-1) are a sulfur atom.

In one embodiment of the present invention, in the general formula (c1-1), it is preferred that $X^1$ and $X^2$ are an oxygen atom, and $X^3$ to $X^8$ are a sulfur atom.

In the general formula (c1-1), from the viewpoint of improving the solubility, a molar ratio of a sulfur atom to an oxygen atom (sulfur atom/oxygen atom) in $X^1$ to $X^8$ is preferably 1/4 to 4/1, and more preferably 1/3 to 3/1.

In the general formula (c1-2), it is preferred that $X^1$ and $X^2$ are an oxygen atom, and $X^3$ and $X^4$ are a sulfur atom.

In the general formula (c1-2), from the same viewpoint as mentioned above, a molar ratio of a sulfur atom to an oxygen atom s[ulfur atom/oxygen atom] in $X^1$ to $X^4$ is preferably 1/3 to 3/1, and more preferably 1.5/2.5 to 2.5/1.5.

The carbon number of the hydrocarbon group which may be selected as $R^1$ to $R^4$ is preferably 1 to 20, more preferably 5 to 18, still more preferably 5 to 16, and yet still more preferably 5 to 12.

Specifically, examples of the hydrocarbon group which may be selected as $R^1$ to $R^4$ include an alkyl group, such as a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group; an alkenyl group, such as an octenyl group, a nonenyl group, a decenyl group, an undecenyl group, a dodecenyl group, a tridecenyl group, a tetradecenyl group, and a pentadecenyl group: a cycloalkyl group, such as a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group; an aryl group, such as a phenyl group, a naphthyl group, an anthracenyl group, a biphenyl group, and a terphenyl group; an alkylaryl group, such as a tolyl group, a dimethylphenyl group, a butylphenyl group, a nonylphenyl group, a methylbenzyl group, and a dimethylnaphthyl group; and an arylalkyl group, such as a phenylmethyl group, a phenylethyl group, and a diphenylmethyl group.

Examples of the molybdenum dithiocarbamate (MoDTC) include a binuclear molybdenum dithiocarbamate having two molybdenum atoms in one molecule thereof; and a trinuclear molybdenum dithiocarbamate having three molybdenum atoms in one molecule thereof.

Of those MoDTCs, a binuclear molybdenum dithiocarbamate is preferred.

As the binuclear molybdenum dithiocarbamate, a compound represented by the following general formula (c2-1) and a compound represented by the following general formula (c2-2) are more preferred.

(c2-1)

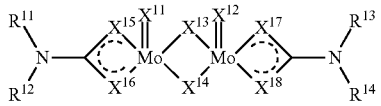

(c2-2)

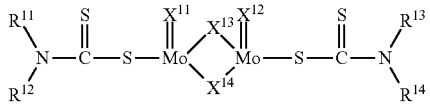

In the general formulae (c2-1) and (c2-2), $R^{11}$ to $R^{14}$ each independently represent a hydrocarbon group, and may be the same as or different from each other.

$X^{11}$ to $X^{18}$ each independently represent an oxygen atom or a sulfur atom, and may be the same as or different from each other.

However, at least one of $X^{11}$ to $X^{18}$ in the formula (c2-1) is a sulfur atom.

In one embodiment of the present invention, in the formula (c2-1), it is preferred that $X^{11}$ and $X^{12}$ are an oxygen atom, and $X^{13}$ to $X^{18}$ are a sulfur atom.

In the general formula (c2-1), from the viewpoint of improving the solubility, a molar ratio of a sulfur atom to an oxygen atom [sulfur atom/oxygen atom] in $X^{11}$ to $X^{18}$ is preferably 1/4 to 4/1, and more preferably 1/3 to 3/1.

It is preferred that $X^{11}$ to $X^{14}$ in the formula (b2-2) are an oxygen atom.

In the general formulae (c2-1) and (c2-2), the carbon number of the hydrocarbon group which may be selected as $R^{11}$ to $R^{14}$ is preferably 1 to 20, more preferably 5 to 18, still more preferably 5 to 16, and yet still more preferably 5 to 13.

As the specific hydrocarbon group which may be selected as $R^{11}$ to $R^{14}$, there are exemplified the same hydrocarbon groups as the hydrocarbon groups which may be selected as $R^1$ to $R^4$ in the general formulae (c1-1) and (c1-2).

As the trinuclear molybdenum dithiocarbamate, a compound represented by the following general formula (c3-1) is preferred.

$$Mo_3S_kE_mL_nA_pQ_z \quad \text{(c3-1)}$$

In the general formula (c3-1), k is an integer of 1 or more; m is an integer of 0 or more; and (k+m) is an integer of 4 to 10, and preferably an integer of 4 to 7. n is an integer of 1 to 4; and p is an integer of 0 or more. z is an integer of 0 to 5, inclusive of a non-stoichiometric value.

E's are each independently an oxygen atom or a selenium atom, and for example, are one capable of substituting sulfur in a core as mentioned later.

L's are each independently an anionic ligand having a carbon atom-containing organic group; a sum total of carbon atoms of the organic group in each of the ligands is 14 or more; and the respective ligands may be the same as or different from each other.

A's are each independently an anion other than L.

Q's are each independently a compound capable of providing a neutral electron and are existent for the purpose of fulfilling a vacant coordination site on the trinuclear molybdenum compound.

A sum total of carbon atoms of the organic group in the anionic ligand(s) represented by L is preferably 14 to 50, more preferably 16 to 30, and still more preferably 18 to 24.

As L, a monoanionic ligand that is a monovalent anionic ligand is preferred, and specifically, ligands represented by the following general formulae (i) to (iv) are more preferred.

In the general formula (c3-1), the anionic ligand which is selected as L is preferably a ligand represented by the foregoing general formula (iv).

In the general formula (c3-1), it is preferred that all of the anionic ligands which are selected as L are the same, and it is more preferred that all of the anionic ligands selected as L are a ligand represented by the foregoing general formula (iv).

(i)

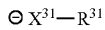

(ii)

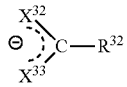

(iii)

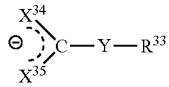

(iv)

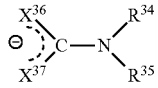

In the general formulae (i) to (iv), $X^{31}$ to $X^{37}$ and Y are each independently an oxygen atom or a sulfur atom, and may be the same as or different from each other.

In the general formulae (i) to (iv), $R^{31}$ to $R^{35}$ are each independently an organic group, and may be the same as or different from each other.

The carbon number of each of the organic groups which may be selected as $R^{31}$, $R^{32}$, and $R^{33}$ is preferably 14 to 50, more preferably 16 to 30, and still more preferably 18 to 24.

The total carbon number of the two organic groups which may be selected as $R^{34}$ and $R^{35}$ in the formula (iv) is preferably 14 to 50, more preferably 16 to 30, and still more preferably 18 to 24.

The carbon number of each of the organic groups which may be selected as $R^{34}$ and $R^{35}$ is preferably 7 to 30, more preferably 7 to 20, and still more preferably 8 to 13.

Although the organic group of $R^{34}$ and the organic group of $R^{35}$ may be the same as or different from each other, they are preferably different from each other. In addition, though the carbon number of the organic group of $R^{34}$ and the carbon number of the organic group of $R^{35}$ may be the same as or different from each other, they are preferably different from each other.

Examples of the organic group which is selected as $R^{31}$ to $R^{35}$ include a hydrocarbyl group, such as an alkyl group, an aryl group, and a substituted aryl group, and an ether group.

The term "hydrocarbyl" expresses a substituent having a carbon atom, which is directly bonded to the residue of the ligand, and in the scope of the present embodiments, characteristics thereof mainly rely on the hydrocarbyl. Examples of such a substituent include the following.

1. Hydrocarbon Substituent

Examples of the hydrocarbon substituent include aliphatic substituents, such as an alkyl group and an alkenyl group; alicyclic substituents, such as a cycloalkyl group and a cycloalkenyl group; and aromatic nuclei substituted with an aromatic group, an aliphatic group, or an alicyclic group; and cyclic groups in which the ring is completed via another site in the ligand (namely, arbitrarily expressed two substituents may each form an alicyclic group).

2. Substituted Hydrocarbon Substituent

Examples of the substituted hydrocarbon substituent include the aforementioned hydrocarbon substituents having, as the substituent, a non-hydrocarbon group which does not change the characteristics of the hydrocarbyl group. Examples of the non-hydrocarbon group include a halogen group, such as a chloro group and a fluoro group, an amino group, an alkoxy group, a mercapto group, an alkyl mercapto group, a nitro group, a nitroso group, and a sulfoxy group.

In the general formula (c3-), as the anionic ligand which is selected as L, ligands derived from an alkylxanthogenate, a carboxylate, a dialkyldithiocarbamate, or a mixture thereof are preferred, and ligands derived from a dialkyldithiocarbamate are more preferred.

In the general formula (c3-1), the anion which may be selected as A may be either a monovalent anion or a divalent anion, and examples of the anion which may be selected as A include a disulfide, a hydroxide, an alkoxide, an amide, a thiocyanate, and derivatives thereof.

In the general formula (c3-1), examples of Q include water, an amine, an alcohol, an ether, and a phosphine. Although Qs may be the same as or different from each other, they are preferably the same as each other.

As the trinuclear molybdenum dithiocarbamate, a compounds represented by the general formula (c3-1) in which k is an integer of 4 to 7; n is 1 or 2; L is a monoanionic ligand; p is an integer of imparting electrical neutrality to the compound based on an anionic charge in A; and m and z are each 0 is preferred; and a compound represented by the general formula (c3-1) in which k is an integer of 4 to 7; L is a monoanionic ligand; n is 4; and p, m, and z are each 0 is more preferred.

As the trinuclear molybdenum dithiocarbamate, for example, a compound having a core represented by the following formula (IV-A) or (IV-B) is preferred. Each core has a net electrical charge of +4. Such a core is surrounded by an anionic ligand and an optionally existing anion other than the anionic ligand.

(IV-A)

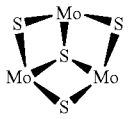

(IV-B)

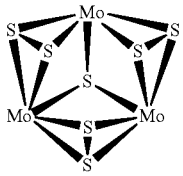

Formation of the trinuclear molybdenum-sulfur compound requires selection of an appropriate anionic ligand (L) and other anion (A), depending on, for example, the number of sulfur and E atoms present in the core, i.e., the total anionic charge constituted of a sulfur atom, an E atom, if present, L, and A, if present, must be −4.

In the case where the anionic charge exceeds −4, the trinuclear molybdenum-sulfur compound may also contain a cation other than molybdenum, for example, an (alkyl) ammonium, an amine, or sodium. A preferred embodiment of the anionic ligand (U and other anion (A) is a constitution having four monoanionic ligands.

The molybdenum-sulfur cores, for example, the structures represented by the aforementioned formulae (V-A) and (V-B), may be interconnected by means of one or more multidentate ligands, i.e., a ligand having more than one functional group capable of binding to a molybdenum atom to form oligomers.

<Additive for Lubricating Oil>

The lubricating oil composition according to one embodiment of the present invention may further contain an additive for a lubricating oil other than the components (B) and (C) (hereinafter also referred to simply as "additive for lubricating oil"), as required, within a range where the effects of the present invention are not impaired.

Examples of such an additive for lubricating oil include a pour-point depressant, a metal-based detergent, a dispersant, an anti-wear agent, an extreme pressure agent, an antioxidant, an anti-foaming agent, a rust inhibitor, and a metal deactivator.

A commercially available additive package containing a plurality of additives and meeting API/ILSAC SN/GF-5 standards may be used as an additive for lubricating oil.

A compound having plural functions as the additive (for example, a compound having functions as an anti-wear agent and an extreme pressure agent) may also be used.

Furthermore, the respective additives for lubricating oil may be used either alone or in combination of two or more thereof.

Although the content of each of such additives for lubricating oil can be appropriately adjusted within a range where the effects of the present invention are not impaired, it is typically 0.001 to 15% by mass, preferably 0.005 to 10% by mass, and more preferably 0.01 to 8% by mass on the basis of the whole amount (100% by mass) of the lubricating oil composition.

In the lubricating oil composition according to one embodiment of the present invention, a total content of these additives for lubricating oil is preferably 0 to 40% by mass, more preferably 0 to 30% by mass, still more preferably 0 to 20% by mass, and yet still more preferably 0 to 15% by mass on the basis of the whole amount (100% by mass) of the lubricating oil composition.

The lubricating oil composition according to one embodiment of the present invention may contain a friction modifier which is not corresponding to the component (C).

Examples of the friction modifier include ash-free friction modifiers, such as an aliphatic amine, a fatty acid ester, a fatty acid amide, a fatty acid, an aliphatic alcohol, and an aliphatic ether, each having at least one alkyl group or alkenyl group having a carbon number of 6 to 30 in a molecule thereof, oils and fats; amines; amides; sulfurized esters; phosphoric acid esters; phosphorous acid esters; and phosphoric acid ester amine salts.

The content of the friction modifier which is not corresponding to the component (C) is preferably 0 to 30 parts by mass, more preferably 0 to 20 parts by mass, and still more preferably 0 to 10 parts by mass based on 100 parts by mass of the whole amount of the component (C).

<Various Physical Properties of Lubricating Oil Composition>

A kinetic viscosity at 100° C. of the lubricating oil composition according to one embodiment of the present invention is preferably 4 $mm^2/s$ or more, more preferably 5 $mm^2/s$ or more, still more preferably 6 $mm^2/s$ or more, and yet still more preferably 7 $mm^2/s$ or more, and it is preferably 15 $mm^2/s$ or less, more preferably 12.5 $mm^2/s$ or less, still more preferably 11 $mm^2/s$ or less, and yet still more preferably 10 $mm^2/s$ or less.

A viscosity index of the lubricating oil composition according to one embodiment of the present invention is preferably 140 or more, more preferably 150 or more, still more preferably 160 or more, and yet still more preferably 180 or more.

From the viewpoint of producing a lubricating oil composition with a good lubrication performance, an HTHS viscosity at 100° C. of the lubricating oil composition according to one embodiment of the present invention is preferably 3.5 mPa·s or more, more preferably 3.7 mPa·s or more, still more preferably 4.0 mPa·s or more, and yet still preferably 4.3 mPa·s or more, and from the viewpoint of producing a lubricating oil composition with excellent fuel consumption, it is preferably 5.5 mPa·s or less, more preferably 5.4 mPa·s or less, still more preferably 5.35 mPa·s or less, yet still more preferably 5.2 mPa·s or less, and especially preferably 5.09 mPa·s or less.

From the viewpoint of producing a lubricating oil composition with a good lubrication performance, an HTHS viscosity at 150° C. of the lubricating oil composition according to one embodiment of the present invention is preferably 1.5 mPa·s or more, more preferably 1.6 mPa·s or more, still more preferably 1.7 mPa·s or more, and yet still preferably 2.0 mPa·s or more, and from the viewpoint of producing a lubricating oil composition with excellent fuel consumption, it is preferably 3.3 mPa·s or less, more preferably 3.2 mPa·s or less, still more preferably 3.1 mPa·s or less, and yet still more preferably 2.8 mPa·s or less.

The HTHS viscosity at 150° C. can also be thought of as a viscosity in a high-temperature region of an engine operating at high speed. Namely, when the HTHS viscosity at 150° C. of the lubricating oil composition falls within the aforementioned range, it may be said that the lubricating oil composition has desirable various properties, such as the viscosity that is thought of as a viscosity in a high-temperature region of an engine operating at high speed, etc.

In this specification, the HTHS viscosity at 100° C. or 150° C. means a value measured in conformity with ASTM D4741.

From the viewpoint of producing a lubricating oil composition having good low-temperature viscosity characteristics, a CCS viscosity (low-temperature viscosity) at −35° C. of the lubricating oil composition according to one embodiment of the present invention is preferably 9,000 mPa·s or less, more preferably 8,000 mPa·s or less, still more preferably 7,000 mPa·s or less, yet still more preferably 6,000 mPa·s or less, and especially preferably 5,000 mPa·s or less.

In this specification, the CCS viscosity at −35° C. means a value measured in conformity with JIS K2010:1993 (ASTM D2602).

With respect to the lubricating oil composition according to one embodiment of the present invention, a coefficient of friction measured with a reciprocating friction tester under conditions described in the section of Examples as mentioned later is preferably 0.120 or less, more preferably 0.100 or less, still more preferably 0.080 or less, yet still more preferably 0.060 or less, and especially preferably 0.055 or less.

In the lubricating oil composition according to one embodiment of the present invention, the content of the molybdenum atom is preferably 500 ppm by mass or more and less than 900 ppm by mass, more preferably 530 ppm by mass or more and 880 ppm by mass or less, and still more preferably 650 ppm by mass or more and 850 ppm by mass or less on the basis of the whole amount (100% by mass) of the lubricating oil composition.

The aforementioned "content of the molybdenum atom" includes not only the molybdenum atom derived from the component (C) but also the content of the molybdenum atom derived from the molybdenum-based compound which is not corresponding to the component (C) contained in the lubricating oil composition.

[Production Method of Lubricating Oil Composition]

Although the method for producing the lubricating oil composition of the present invention is not particularly limited, a production method including the following step (1) is preferred.

Step (1): A step of blending a base oil (A) containing a mineral oil (A) having a complex viscosity $\eta^*$ at −35° C. of 150 Pa·s or less as measured with a rotary rheometer under conditions at an angular velocity of 6.3 rads and a strain amount of 0.1%, with a viscosity index improver (B) containing a comb-shaped polymer (B1) and a molybdenum-based friction modifier (C), wherein the content of the molybdenum-based friction modifier (C) in terms of a molybdenum atom is more than 500 ppm by mass and less than 900 ppm by mass, and a NOACK value is 10% by mass or less.

In the step (1), the mineral oil (A) and the base oil (A), the comb-shaped polymer (B1) and the viscosity index improver (B), and the molybdenum-based friction modifier (C) are those as mentioned above, and the preferred components and the contents of the respective components are also those as mentioned above.

In the present step, the aforementioned additives for lubricating oil other than the components (B) and (C) may also be blended.

The component (B) may be blended in a form of a solution having the resin component containing the comb-shaped polymer (B) dissolved in a diluent oil. A solid component concentration of the solution is typically 10 to 50% by mass.

It is preferred that after blending the respective components, the resulting blend is stirred and uniformly dispersed by a known method.

[Application of Lubricating Oil Composition]

The lubricating oil composition of the present invention is one which is reduced in evaporativity, and it has excellent friction-reducing effect and low-temperature viscosity characteristics, is excellent in fuel consumption, and furthermore, is good in solubility with additives.

Accordingly, examples of engines filled with the lubricating oil composition of the present invention include engines for vehicles, such as automobiles, electric trains, and aircraft. Preferred are automobile engines, and more preferred are automobile engines equipped with a hybrid mechanism or a start-up system.

Although the lubricating oil composition according to one embodiment of the present invention is suitable for uses as a lubricating oil composition for internal combustion engines of vehicles, such as automobiles, electric trains, and aircraft (engine oils for internal combustion engines), it is also applicable for other uses.

The lubricating oil composition of the present invention is suited for lubrication for a sliding mechanism equipped with a piston ring and a liner in a device having a sliding mechanism having a piston ring and a liner, particularly a sliding mechanism equipped with a piston ring and a liner in an internal combustion engine (preferably, an internal combustion engine of automobile).

A material for forming the piston ring or liner to which the lubricating oil composition of the present invention is applied is not particularly limited.

Examples of a piston ring-forming material include a Si—Cr steel, a martensite-based stainless steel containing 11 to 17% by mass of Cr, and the like. Preferably, the piston ring-forming material is subjected to a substrate treatment according to a chromium plating treatment, a chromium nitride treatment, a nitriding treatment, or a combination thereof.

Examples of a liner-forming material include an aluminum alloy and a cast iron alloy.

[Internal Combustion Engine]

The present invention also provides an internal combustion engine having a sliding mechanism equipped with a piston ring and a liner and including the aforementioned lubricating oil composition of the present invention.

In one embodiment of the present invention, an internal combustion engine in which the lubricating oil composition of the present invention is applied to a sliding portion of the aforementioned sliding mechanism is preferred.

The lubricating oil composition of the present embodiment and the sliding mechanism equipped with a piston ring and a liner are those as mentioned above, and as a specific configuration of the sliding mechanism, there is exemplified one shown in FIG. 2.

A sliding mechanism 1 shown in FIG. 2 includes a block 2 having a piston travel path 2*a* and a crank shaft housing 2*b*, a liner 12 disposed along the inner wall of the piston travel path 2*a*, a piston 4 housed inside the liner 12, piston rings 6 fitted around the piston 4, a crank shaft 10 housed inside the crank shaft housing 2*b*, a con'rod 9 that connects the crank shaft 10 to the piston 4, and a structure interposed between the liner 12 and the piston travel path 2*a*.

The crank shaft 10 is rotatably driven by a non-illustrated motor and enables the piston 4 to make a reciprocating motion via the con'rod 9.

In the sliding mechanism 1 of such a configuration, a lubricating oil composition 20 of the present invention is charged into the crank shaft housing 2*b* until the liquid level is above the center of the central axis of the crank shaft 10 and below the uppermost end of the central axis. The lubricating oil composition 20 in the crank shaft housing 2*b* is supplied between the liner 12 and the piston rings 6 by being splashed with the rotating crank shaft 10.

[Lubrication Method of Internal Combustion Engine]

The present invention also provides a lubrication method of an internal combustion engine for lubricating a device having a sliding mechanism equipped with a piston ring and a liner, the method including lubricating the piston ring and the liner with the aforementioned lubricating oil composition of the present invention.

The lubricating oil composition of the present embodiment and the sliding mechanism equipped with a piston ring and a liner are those as mentioned above.

In the lubrication method of an internal combustion engine of the present invention, by using the lubricating oil composition of the present embodiment as a lubricating oil for the sliding portion between the piston ring and the liner, the friction is greatly reduced in both fluid lubrication and mixed lubrication, thereby enabling one to contribute to an improvement of the fuel consumption.

EXAMPLES

The present invention is hereunder described in more detail by reference to Examples, but it should be construed that the present invention is by no means limited by the following Examples. The measurement methods and evaluation methods of various physical properties are as follows.

<Physical Properties of Base Oil or Lubricating Oil Composition>

(1) Kinetic Viscosities at 40° C. and 100° C.

The measurement was performed in conformity with JIS K2283:2000.

(2) Viscosity Index

The calculation was performed in conformity with JIS K2283:2000.

<Physical Properties of Base Oil>

(3) Complex Viscosities $\eta^*$ at −35° C., −25° C., and −10° C.

The measurement was performed by using a rheometer, "Physica MCR 301", manufactured by Anton Paar according to the following procedures.

First of all, a sample oil to be measured was inserted in a cone plate (diameter: 50 mm, tilt angle: 1°) that had been adjusted to a measurement temperature of any one of −35° C., −25° C., and −10° C. and then held at the same temperature for 10 minutes. On this occasion, care was taken so as not to induce a strain in the inserted solution.

The complex viscosity $\eta^*$ was then measured at the predetermined measurement temperatures in a vibration mode at an angular velocity of 6.3 rad/s and a strain amount ranging from 0.1 to 100% which was appropriately selected according to the measurement temperature. In the measurement at −35° C., the strain amount was set to "0.1%"; in the measurement at −10° C., the strain amount was set to "2.1%"; and the measurement at −25° C., the strain amount was set to "0.4%"

The "temperature gradient $\Delta|\eta^*|$ of complex viscosity" was then calculated from the values of complex viscosity $\eta^*$ at −25° C. and −10° C. according to the aforementioned calculation formula (f1).

<Physical Properties of Viscosity Index Improver>

(4) Weight Average Molecular Weight (Mw) and Number Average Molecular Weight (Mn)

The measurement was performed by using a gel permeation chromatography device ("1260 Type HPLC", manufactured by Agilent) under the following conditions, and the values measured in terms of a standard polystyrene conversion were adopted.

(Measurement Conditions)

Column: Two "Shodex LF404" columns connected in series

Column temperature: 36° C.

Developing solvent: Chloroform

Flow rate: 0.3 mL/min (5) SSI (Shear Stability Index)

To a viscosity index improver to be measured, a mineral oil that is a diluent oil was added to prepare a sample oil, and the SSI was measured using the sample oil and the mineral oil in conformity with ASTM D6278.

Specifically, with respect to the viscosity index improver to be measured, each of $Kv_0$, $Kv_1$, and $Kv_{oil}$ values in the aforementioned calculation formula (1) was measured and calculated according to the calculation formula (1).

<Physical Properties and Evaluations of Lubricating Oil Composition>

(6) NOACK Value

The measurement was performed under conditions at 250° C. for 1 hour in conformity with JPI-5S-41-2004.

(7) Content of Molybdenum Atom

The measurement was performed in conformity with JPI-5S-38-92.

(8) HTHS Viscosity (High-Temperature High-Shear Viscosity) at 100° C. or 150° C.

After shearing a lubricating oil composition to be measured at a shear rate of 101 under temperature conditions at 100° C. or 150° C., the viscosity was measured in conformity with ASTM D4741.

(9) CCS Viscosity at −35° C.

The measurement was performed in conformity with JIS K2010:1993 (ASTM D2602).

(10) Coefficient of Friction

The coefficient of friction was measured with a reciprocating friction tester (SRV reciprocating friction tester, manufactured by Optimal inc.) according to the following procedures.

First of all, a disk (diameter: 24 mm, thickness: 7.9 mm, material: SUJ-2) was used as a test piece, a few drops of the prepared lubricating oil composition were dropped on the disk, and a cylinder (diameter: 15 mm, length: 22 mm, material of cylinder pin: SUJ-2) was then set in an upper part of the disk.

The coefficient of friction was determined in that state under conditions at a load of 400 N, an amplitude of 1.5 mm, a frequency of 50 Hz, and a temperature of 100° C.

(11) Evaluation of Solubility

After allowing 100 mL of a lubricating oil composition to be measured to stand in an environment at −5° C. for 5 days, on the occasion of returning to room temperature (20°), the presence or absence of cloudiness (precipitate) of the lubricating oil composition was confirmed through visual inspection and evaluated according to the following criteria.

A: The cloudiness was not confirmed in the lubricating oil composition, and a precipitate of additives was not observed.

F: The cloudiness was observed in the lubricating oil composition, and a precipitate which was thought to b caused due to the additives was confirmed.

Examples 1 to 6 and Comparative Examples 1 to 9

A base oil, a viscosity index improver, a friction modifier, and an additive package of the kinds and blending amounts shown in Table 1 or 2 were blended, thereby preparing lubricating oil compositions, respectively.

Details of the used base oil, viscosity index improver, friction modifier, and additive package are as follows.

<Base Oil>

Base oil (1): A mineral oil obtaining by subjecting a feedstock oil containing a slack wax and a bottom oil (slack wax/bottom oil=95/5 (mass ratio)) to a hydroisomerization dewaxing process and then subjecting the resultant to a hydrofinishing process. Kinematic viscosity at 100° C.=4.1 $mm^2/s$; viscosity index=129; complex viscosity η* at −35° C.=3.5 Pa·s; temperature gradient Δ|η*| of complex viscosity between two temperature points −10° C. and −25° C.=0.03 Pa·s/° C.; % $C_A$=−0.2; % $C_N$=6.5.

Base oil (2): A mineral oil obtaining by subjecting a feedstock oil containing a slack wax and a bottom oil (slack wax/bottom oil=95/5 (mass ratio)) to a hydroisomerization dewaxing process and then subjecting the resultant to a hydrofinishing process. Kinematic viscosity at 100° C.=7.7 $mm^2/s$; viscosity index=140; complex viscosity η* at −35° C.=25.4 Pa·s; temperature gradient Δ|η*| of complex viscosity between two temperature points −10° C. and −25° C.=0.12 Pa·s/° C.; % $C_A$=−0.3; % $C_N$=6.5.

Base oil (3): A mineral oil obtaining by subjecting a feedstock oil containing a slack wax and a bottom oil (slack wax/bottom oil=95/5 (mass ratio)) to a hydroisomerization dewaxing process and then subjecting the resultant to a hydrofinishing process. Kinematic viscosity at 100° C.=2.7 $mm^2/s$; viscosity index=114; complex viscosity η* at −35° C.=1.4 Pa·s; temperature gradient Δ|η*| of complex viscosity between two temperature points −10° C. and −25° C.=0.01 Pa·s/C; % $C_A$=0.4; % $C_N$=7.1.

Base oil (4): A mineral oil obtaining by subjecting a feedstock oil containing a slack wax and a bottom oil (slack wax/bottom oil=30/70 (mass ratio)) to a hydroisomerization dewaxing process and then subjecting the resultant to a hydrofinishing process, followed by performing vacuum distillation to recover a fraction having a kinematic viscosity at 100° C. ranging from 4.0 to 4.5 $mm^2/s$. Kinematic viscosity at 100° C.=4.3 $mm^2/s$; viscosity index=123; complex viscosity η* at −35° C.=10,000 Pa·s; temperature gradient Δ|η*| of complex viscosity between two temperature points −10° C. and −25° C.=4.80 Pa·s/C;% $C_A$=−0.7; % $C_N$=23.

Base oil (5): A mineral oil obtaining by subjecting a feedstock oil containing a slack wax and a bottom oil (slack wax/bottom oil=30/70 (mass ratio)) to a hydroisomerization dewaxing process and then subjecting the resultant to a hydrofinishing process, followed by performing vacuum distillation to recover a fraction having a kinematic viscosity at 100° C. ranging from 7.0 to 7.5 $mm^2/s$. Kinematic viscosity at 100° C.=7.3 $mm^2/s$; viscosity index=130; complex viscosity η* at −35° C.=33,000 Pa·s; temperature gradient Δ|η*| of complex viscosity between two temperature points −10° C. and −25° C.=12 Pa·s/C; % $C_A$=−0.2; % $C_N$=21.4.

The aforementioned bottom oils contained in the base oils (1) to (5) as the feedstock oil are each a bottom fraction remained after hydrocracking of an oil containing a heavy fuel oil obtained from a vacuum distillation device in a common fuel oil producing process, followed by separation and removal of naphtha and a kerosene-gas oil.

<Viscosity Index Improver>

Viscosity index improver (1): A comb-shaped polymer having at least a constituent unit derived from a macromonomer having a Mn of 500 or more (Mw=600,000, Mw/Mn=2.40, SSI=0.9).

Viscosity index improver (2): A comb-shaped polymer having at least a constituent unit derived from a macromonomer having a Mn of 500 or more (Mw=390,000, Mw/Mn=5.21, SSI=0.3).

Viscosity index improver (3): A comb-shaped polymer having at least a constituent unit derived from a macromonomer having a Mn of 500 or more (Mw=450,000, Mw/Mn=5.5, SSI=13.5).

Viscosity index improver (4): A polymethacrylate (Mw=400,000, Mw/Mn=1.72, SSI=30.7).

Viscosity index improver (5): An olefin copolymer (Mw=60, Mw/Mn=1.14, SSI=12.2).

<Molybdenum-based Friction Modifier>

Organic Mo-based compound: ADEKA SAKURA-LUBE 515 (manufactured by Adeka Corporation); content of molybdenum atom=10.0% by mass; content of sulfur atom=11.5% by mass. A binuclear molybdenum dialkyldithiocarbamate represented by the following formula:

[Chem. 7]

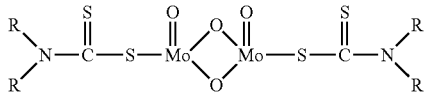

In the formula, Rs are each independently a hydrocarbon group having a carbon number of 8 or 13.

<Additive Package>

Additive package for engine: An additive package adapted to the API/ILSAC standards and the SN/GF-5 standards and containing the following various additives.

Metal-based detergent: Calcium salicylate

Dispersant: Macromolecular bisimide and boron-modified monoimide

Anti-wear agent: Primary ZnDTP and secondary ZnDTP

Antioxidant: Diphenylamine-based antioxidant and hindered phenol-based antioxidant Metal deactivator: Benzotriazole Anti-foaming agent: Silicone-based anti-foaming agent

TABLE 1

| | | | Example 1 | Example 2 | Example 3 | Example 4 | Example 5 | Example 6 |
|---|---|---|---|---|---|---|---|---|
| Lubricating oil composition | | | (I) | (II) | (III) | (IV) | (V) | (VI) |
| Composition of lubricating oil composition | Base oil (1) | % by mass | 67.75 | 67.63 | 67.82 | 67.65 | 67.78 | 67.65 |
| | Base oil (2) | % by mass | 20.00 | 20.00 | 20.00 | 20.00 | 20.00 | 20.00 |
| | Base oil (3) | % by mass | — | — | — | — | — | — |
| | Base oil (4) | % by mass | — | — | — | — | — | — |
| | Base oil (5) | % by mass | — | — | — | — | — | — |
| | Viscosity index improver (1) | % by mass | 1.73 | — | — | 1.73 | 2.60 | 1.52 |
| | Viscosity index improver (2) | % by mass | — | 1.85 | — | — | — | — |
| | Viscosity index improver (3) | % by mass | — | — | 1.56 | — | — | — |
| | Viscosity index improver (4) | % by mass | — | — | — | — | — | 0.21 |
| | Viscosity index improver (5) | % by mass | — | — | — | — | — | — |
| | Organic Mo-based compound | % by mass | 0.70 | 0.70 | 0.80 | 0.80 | 0.80 | 0.80 |
| | | Content in terms of Mo (ppm by mass) | 700 | 700 | 800 | 800 | 800 | 800 |
| | Additive package for engine oil | % by mass | 9.82 | 9.82 | 9.82 | 9.82 | 9.82 | 9.82 |
| | Total | % by mass | 100.00 | 100.00 | 100.00 | 100.00 | 100.00 | 100.00 |
| NOACK valve of lubricating oil composition (at 250° C. for 1 hr) | | % by mass | 9.1 | 9.4 | 9.5 | 9.2 | 9.8 | 9.3 |
| Content proportion of comb-shaped polymer in the whole amount (100% by mass) of viscosity index improver | | % by mass | 100.0 | 100.0 | 100.0 | 100.0 | 100.0 | 87.9 |
| Content of organic Mo-based compound in terms of Mo based on 100 pats by mass of comb-shaped polymer | | part by mass | 4.05 | 3.78 | 5.13 | 4.62 | 3.08 | 5.26 |

TABLE 1-continued

| | | | Example 1 | Example 2 | Example 3 | Example 4 | Example 5 | Example 6 |
|---|---|---|---|---|---|---|---|---|
| Physical properties of base oil | Kinematic viscosity at 40° C. | $mm^2/s$ | 22.19 | 22.20 | 22.19 | 22.20 | 22.24 | 22.20 |
| | Kinematic viscosity at 100° C. | $mm^2/s$ | 4.707 | 4.708 | 4.707 | 4.708 | 4.714 | 4.708 |
| | Viscosity index | — | 134 | 134 | 134 | 134 | 134 | 134 |
| | Complex viscosity at −35° C. | Pa · s | 6.5 | 6.5 | 6.5 | 6.5 | 6.5 | 6.5 |
| Physical properties and evaluation of lubricating oil composition | Content of Mo atom | ppm by mass | 700 | 700 | 800 | 800 | 800 | 800 |
| | Kinematic viscosity at 40° C. | $mm^2/s$ | 33.37 | 33.79 | 33.75 | 33.38 | 35.23 | 33.60 |
| | Kinematic viscosity at 100° C. | $mm^2/s$ | 7.458 | 7.523 | 7.977 | 7.462 | 8.422 | 7.393 |
| | Viscosity index | — | 202 | 200 | 222 | 202 | 246 | 195 |
| | HTHS viscosity (at 100° C.) | mPa · s | 5.05 | 5.10 | 5.34 | 5.07 | 5.35 | 5.05 |
| | HTHS viscosity (at 150° C.) | mPa · s | 2.66 | 2.65 | 2.62 | 2.66 | 3.01 | 2.63 |
| | CCS viscosity (at −35° C.) | mPa · s | 4600 | 4700 | 4800 | 4700 | 4800 | 4600 |
| | Coefficient of friction | — | 0.049 | 0.051 | 0.051 | 0.050 | 0.051 | 0.050 |
| | Evaluation of solubility | — | A | A | A | A | A | A |

TABLE 2

| | | | Comparative Example 1 | Comparative Example 2 | Comparative Example 3 | Comparative Example 4 | Comparative Example 5 |
|---|---|---|---|---|---|---|---|
| Lubricating oil composition | | | (ii) | (ii) | (iii) | (iv) | (v) |
| Composition of lubricating oil composition | Base oil (1) | % by mass | 67.89 | 68.97 | 68.39 | 67.99 | 71.85 |
| | Base oil (2) | % by mass | 20.00 | 20.00 | 20.00 | 20.00 | — |
| | Base oil (3) | % by mass | — | — | — | — | 15.00 |
| | Base oil (4) | % by mass | — | — | — | — | — |
| | Base oil (5) | % by mass | — | — | — | — | — |
| | Viscosity index improver (1) | % by mass | — | — | — | — | 2.63 |
| | Viscosity index improver (2) | % by mass | — | — | — | — | — |
| | Viscosity index improver (3) | % by mass | — | — | — | — | — |
| | Viscosity index improver (4) | % by mass | 1.69 | — | 1.69 | 1.69 | — |
| | Viscosity index improver (5) | % by mass | — | 0.61 | — | — | — |
| | Organic Mo-based compound | % by mass | 0.60 | 0.60 | 0.10 | 0.50 | 0.70 |
| | | Content in terms of Mo (ppm by mass) | 600 | 600 | 100 | 500 | 700 |
| | Additive package for engine oil | % by mass | 9.82 | 9.82 | 9.82 | 9.82 | 9.82 |
| | Total | % by mass | 100.00 | 100.00 | 100.00 | 100.00 | 100.00 |
| NOACK valve of lubricating oil composition (at 250° C. for 1 hr) | | % by mass | * | 9.5 | 9.7 | 9.8 | 15.9 |
| Content proportion of comb-shaped polymer in the whole amount (100% by mass) of viscosity index improver | | % by mass | 0.0 | 0.0 | 0.0 | 0.0 | 100.0 |
| Content of organic Mo-based compound in terms of Mo based on 100 pats by mass of comb-shaped polymer | | part by mass | — | — | — | 9.8 | 2.66 |

TABLE 2-continued

| | | | | | | | |
|---|---|---|---|---|---|---|---|
| Physical properties of base oil | Kinematic viscosity at 40° C. | $mm^2/s$ | 22.18 | 22.14 | 22.16 | 22.18 | 16.42 |
| | Kinematic viscosity at 100° C. | $mm^2/s$ | 4.706 | 4.699 | 4.703 | 4.706 | 3.824 |
| | Viscosity index | — | 134 | 134 | 134 | 134 | 126 |
| | Complex viscosity at −35° C. | Pa · s | 6.5 | 6.5 | 6.5 | 6.5 | 3.1 |
| Physical properties and evaluation of lubricating oil composition | Content of Mo atom | ppm by mass | * | 600 | 100 | 500 | 700 |
| | Kinematic viscosity at 40° C. | $mm^2/s$ | * | 45.51 | 35.62 | 35.62 | 27.48 |
| | Kinematic viscosity at 100° C. | $mm^2/s$ | * | 8.535 | 7.895 | 7.895 | 7.458 |
| | Viscosity index | — | * | 168 | 203 | 203 | 263 |
| | HTHS viscosity (at 100° C.) | mPa · s | * | 5.62 | 5.11 | 5.12 | 4.48 |
| | HTHS viscosity (at 150° C.) | mPa · s | * | 2.62 | 2.61 | 2.62 | 2.60 |
| | CCS viscosity (at −35° C.) | mPa · s | * | 5100 | 4800 | 4800 | 2600 |
| | Coefficient of friction | — | * | 0.048 | 0.152 | 0.058 | 0.049 |
| | Evaluation of solubility | — | * | F | A | A | A |

| | | | Comparative Example 6 | Comparative Example 7 | Comparative Example 8 | Comparative Example 9 |
|---|---|---|---|---|---|---|
| Lubricating oil composition | | | (vi) | (vii) | (viii) | (ix) |
| Composition of lubricating oil composition | Base oil (1) | % by mass | — | 67.56 | 67.55 | 65.81 |
| | Base oil (2) | % by mass | — | 20.00 | 20.00 | 20.00 |
| | Base oil (3) | % by mass | — | — | — | — |
| | Base oil (4) | % by mass | 43.85 | — | — | — |
| | Base oil (5) | % by mass | 45.00 | — | — | — |
| | Viscosity index improver (1) | % by mass | 0.63 | 1.30 | 1.73 | 3.47 |
| | Viscosity index improver (2) | % by mass | — | — | — | — |
| | Viscosity index improver (3) | % by mass | — | — | — | — |
| | Viscosity index improver (4) | % by mass | — | 0.42 | — | — |
| | Viscosity index improver (5) | % by mass | — | — | — | — |
| | Organic Mo-based compound | % by mass | 0.70 | 0.90 | 0.90 | 0.90 |
| | | Content in terms of Mo (ppm by mass) | 700 | 900 | 900 | 900 |
| | Additive package for engine oil | % by mass | 9.82 | 9.82 | 9.82 | 9.82 |
| | Total | % by mass | 100.00 | 100.00 | 100.00 | 100.00 |
| NOACK valve of lubricating oil composition (at 250° C. for 1 hr) | | % by mass | 9.9 | 9.4 | 9.3 | 9.8 |
| Content proportion of comb-shaped polymer in the whole amount (100% by mass) of viscosity index improver | | % by mass | 100.0 | 75.6 | 100.0 | 100.0 |
| Content of organic Mo-based compound in terms of Mo based on 100 pats by mass of comb-shaped polymer | | part by mass | 11.11 | 6.92 | 5.20 | 2.59 |
| Physical properties of base oil | Kinematic viscosity at 40° C. | $mm^2/s$ | 28.92 | 22.20 | 22.22 | 22.28 |
| | Kinematic viscosity at 100° C. | $mm^2/s$ | 5.524 | 4.709 | 4.709 | 4.721 |
| | Viscosity index | — | 131 | 134 | 134 | 134 |
| | Complex viscosity at −35° C. | Pa · s | 28448.5 | 6.5 | 6.5 | 6.5 |

TABLE 2-continued

| | | | | | | |
|---|---|---|---|---|---|---|
| Physical properties and evaluation of lubricating oil composition | Content of Mo atom | ppm by mass | 700 | 900 | 900 | 900 |
| | Kinematic viscosity at 40° C. | $mm^2/s$ | 38.65 | 33.78 | 33.40 | 37.08 |
| | Kinematic viscosity at 100° C. | $mm^2/s$ | 7.303 | 7.422 | 7.472 | 9.379 |
| | Viscosity index | — | 157 | 195 | 202 | 278 |
| | HTHS viscosity (at 100° C.) | mPa · s | 5.62 | 5.07 | 5.08 | 5.66 |
| | HTHS viscosity (at 150° C.) | mPa · s | 2.64 | 2.63 | 2.65 | 3.44 |
| | CCS viscosity (at −35° C.) | mPa · s | 10200 | 4600 | 4700 | 5000 |
| | Coefficient of friction | — | 0.050 | 0.051 | 0.049 | 0.052 |
| | Evaluation of solubility | — | A | F | F | A |

* In the prepared Lubricating oil composition, a large amount of the Mo-based friction modifier precipitated, so that the various physical property values could not be measured.

The lubricating oil compositions (I) to (VI) prepared in Examples 1 to 6 have the NOACK value of 10% by mass or less, are excellent in the low evaporativity, and are low in the HTHS viscosity at 100° C., and therefore, they are excellent in the fuel consumption. In addition, the lubricating oil compositions (I) to (VI) prepared in Examples 1 to 6 were good in the low-temperature viscosity characteristics, friction-reducing effect, and solubility.

On the other hand, the lubricating oil compositions (ii) to (iv) and (vi) to (ix) prepared in Comparative Examples 2 to 4 and 6 to 9 revealed such a result that one or more characteristics of the fuel consumption, low-temperature viscosity characteristics, friction-reducing effect, and solution are inferior.

In addition, as for the lubricating oil composition (v) prepared in Comparative Example 5, the NOACK value is more than 15, and when used for lubricating an engine part or the like with a large thermal load, the evaporation is large, so that the amount of oil decreases following the use, and there is a concern that breakage of parts following a shortage of the amount of oil is generated.

In the lubricating oil composition (i) prepared in Comparative Example 1, a large amount of the blended molybdenum-based friction modifier precipitated, so that the various physical property values could not be measured.

REFERENCE SIGNS LIST

1: Sliding mechanism
2: Block
2*a*: Piston travel path
2*b*: Crank shaft housing
4: Piston
6, 8: Piston ring
10: Crank shaft
12: Liner

The invention claimed is:

1. A lubricating oil composition, comprising a base oil (A) containing a mineral oil (A1) having a complex viscosity η* at −35° C. of 150 Pa·s or less as measured with a rotary rheometer under conditions at an angular velocity of 6.3 rad/s and a strain amount of 0.1%, wherein the mineral oil (A1) is at least 70% by mass of the total mass of the base oil (A);

a viscosity index improver (B) containing a comb-shaped polymer (B1); and wherein the content of the comb-shaped polymer (B1) is 1 to 3.2% by mass based on the total mass of the lubricating oil composition, the comb-shaped polymer (B1) has a Mw of 200,000 to 1,000,000, and the comb-shaped polymer (B1) contains poly (meth)acrylate macromonomer side chains having an Mn of 500 or more;

a molybdenum-based friction modifier (C), wherein the content of the molybdenum-based friction modifier (C) in terms of a molybdenum atom is more than 500 ppm by mass and less than 900 ppm by mass on the basis of the whole amount of the lubricating oil composition and the molybdenum-based friction modifier (C) is a molybdenum dialkyl dithiocarbamate, and a NOACK value of the lubricating oil composition is 10% by mass or less.

2. The lubricating oil composition according to claim 1, wherein the mineral oil (A1) satisfies the following requirement (II):

Requirement (II): a temperature gradient Δ|η*| of complex viscosity between two temperature points −10° C. and −25° C. as measured with a rotary rheometer under conditions at an angular velocity of 6.3 rad/s and a strain amount of 0.1 to 100% is 1.0 Pa·s/° C. or less.

3. The lubricating oil composition according to claim 1, wherein a kinematic viscosity at 100° C. of the base oil (A) is from 4 to 8 $mm^2/s$.

4. The lubricating oil composition according to claim 1, wherein the mineral oil (A1) is one obtained by purifying a feedstock oil containing a petroleum-derived wax.

5. The lubricating oil composition according to claim 1, wherein the mineral oil (A1) is one obtained by purifying a feedstock oil containing a petroleum-derived wax and a bottom oil.

6. The lubricating oil composition according to claim 1, wherein a content proportion of the comb-shaped polymer (B1) in the whole amount of the viscosity index improver (B) is from 80 to 100% by mass.

7. The lubricating oil composition according to claim 1, wherein the content of the comb-shaped polymer (B1) is from 0.1 to 2.4% by mass on the basis of the whole amount of the lubricating oil composition.

8. The lubricating oil composition according to claim 1, wherein the content of the molybdenum-based friction modifier (C) in terms of a molybdenum atom is from 1.0 to 10.0 parts by mass based on 100 parts by mass of the comb-shaped polymer (B1).

9. The lubricating oil composition according to claim 1, which has a high-temperature high-shear viscosity (HTHS viscosity) at 100° C. of 5.5 mPa·s or less.

10. An internal combustion engine, comprising a sliding mechanism equipped with a piston ring and a liner, and the lubricating oil composition according to claim 1.

11. A method for lubricating an internal combustion engine having a sliding mechanism equipped with a piston ring and a liner, the method comprising lubricating the piston ring and the liner with the lubricating oil composition according to claim 1.

12. The lubricating oil composition according to claim 1, wherein a kinematic viscosity at 100° C. of the lubricating oil composition is from 4 to 15 $mm^2/s$.

13. The lubricating oil composition according to claim 1, wherein the comb-shaped polymer (B1) has an Mw=of from 390,000 to 600,000, an Mw/Mn of from 2.4 to 5.5, and an SSI of from 0.3 to 13.5.

14. The lubricating oil composition according to claim 1, wherein the lubricating oil composition has a CCS viscosity at −35° C. of from 4,600 to 4,800 mPa·s.

* * * * *